US007866789B2

(12) United States Patent
Shigeno et al.

(10) Patent No.: US 7,866,789 B2
(45) Date of Patent: Jan. 11, 2011

(54) INKJET PRINTING APPARATUS AND METHOD OF CONTROLLING AN INK SUCTION PUMP MOTOR

(75) Inventors: Kenji Shigeno, Yokohama (JP); Tetsuya Ishikawa, Yokohama (JP); Haruyuki Yanagi, Machida (JP); Kentaro Onuma, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 42 days.

(21) Appl. No.: 12/091,268

(22) PCT Filed: Oct. 25, 2006

(86) PCT No.: PCT/JP2006/321289

§ 371 (c)(1),
(2), (4) Date: Sep. 26, 2008

(87) PCT Pub. No.: WO2007/049650

PCT Pub. Date: May 3, 2007

(65) Prior Publication Data

US 2009/0289974 A1 Nov. 26, 2009

(30) Foreign Application Priority Data

Oct. 25, 2005 (JP) ..... 2005-310142
Oct. 24, 2006 (JP) ..... 2006-288738

(51) Int. Cl.
*B41J 2/165* (2006.01)

(52) U.S. Cl. ..... 347/30; 388/930

(58) Field of Classification Search ..... 388/930; 347/30

See application file for complete search history.

(56) References Cited

U.S. PATENT DOCUMENTS

| | | | | |
|---|---|---|---|---|
| 4,884,013 | A * | 11/1989 | Jackson et al. | 318/481 |
| 6,356,710 | B1 * | 3/2002 | Sato et al. | 388/804 |
| 6,577,089 | B1 * | 6/2003 | Piedl et al. | 318/432 |
| 2005/0052490 | A1 | 3/2005 | Shimizu et al. | |
| 2005/0074337 | A1 * | 4/2005 | Anderson et al. | 417/44.11 |
| 2006/0071965 | A1 | 4/2006 | Igarashi et al. | |

FOREIGN PATENT DOCUMENTS

| | | |
|---|---|---|
| JP | 5-113177 | 5/1993 |
| JP | 2000-118000 | 4/2000 |
| JP | 2001-138545 | 5/2001 |
| JP | 2004-284189 | 10/2004 |
| JP | 2004-314622 | 11/2004 |
| JP | 2006-90249 | 4/2006 |

* cited by examiner

OTHER PUBLICATIONS

International Preliminary Report on Patentability and translation in PCT Application No. PCT/JP2006/321289 dated May 8, 2008.

*Primary Examiner*—Matthew Luu
*Assistant Examiner*—Shelby Fidler
(74) *Attorney, Agent, or Firm*—Fitzpatrick, Cella, Harper & Scinto

(57) ABSTRACT

In order to stabilize a performance of a pump employed for processing in an inkjet printing apparatus such as sucking ink from a printing head with a low cost configuration and without the need of using any specific detecting unit, the following configuration is employed. Namely, a tube pump having a member with a curved surface aligned with a flexible tube for supporting the tube and a roller which moves while pressing (squeezing) the flexible tube is driven with a DC motor. To keep revolutions always constant, a current PWM control is employed for changing a power applied to the motor according to load fluctuations, and a phase of the roller is determined based on the current PWM value to manage a pressure generated by the pump and a discharge rate.

8 Claims, 19 Drawing Sheets

INKJET PRINTING APPARATUS AND METHOD OF CONTROLLING AN INK SUCTION PUMP MOTOR

TECHNICAL FIELD

The present invention relates to an inkjet printing apparatus and a method of controlling the apparatus, and more specifically to an inkjet printing apparatus having a unit for generating a pressure for processing performed within the apparatus by making use of the pressure and a method of controlling the apparatus.

BACKGROUND ART

An inkjet printing apparatus is used for printing an image on a printing medium by ejecting ink from a printing unit (a printing head), and has the advantage that downsizing of the printing unit is easy and an extremely fine image can be printed at a high speed. Furthermore, because printing can be performed even on plain paper without needing any specific processing, the inkjet printing apparatus also has the advantage that the running cost is low. In addition, there are the advantages that the inkjet printing system is a non-impact printing system and therefore noises are small, and that the printing system can easily be applied to applications for printing color images using multiple color inks.

In the inkjet printing apparatus, often a pressure is utilized for carrying out processing within the apparatus. (Refer to, for instance, Patent Documents 1 to 3).

For instance, in printing apparatuses in which an ink is successively supplied from an ink storage section (an ink tank section) in response to a printing operation (ejection of ink), there are some apparatuses in which, when no ink remains in an ink tank by printing, and the ink tank is exchanged with a new one. In this case, to again fill an ink supply path up to the printing head with an ink, a process for sucking the ink is performed by applying a pressure (a negative pressure) lower than the atmospheric pressure to a face of the printing head (referred to as "ejection face" hereinafter) on which ink ejection openings are provided.

Furthermore, there are inkjet printing apparatuses in which a cleaning unit (also referred to as "restoring unit") for cleaning a printing head is provided for obtaining excellent image quality by maintaining or restoring the ink ejecting operation in or to the stable state. This cleaning unit has mainly two mechanisms. One of the mechanisms is a wiping mechanism for wiping off dust, or droplets of water or ink deposited on the ejection face, and this mechanism relatively moves a wiping member (also referred to as "blade" or "wiper") made of an elastic material such as urethane rubber and having a plate-like form while the wiping member is contacted to the ejection face. Another one is a mechanism for resolving clogging caused by fixation of ink inside an ejection opening or for any other reason, and a pressure is used for this mechanism. For instance, clogging is resolved by applying a negative pressure to the ejection face to forcibly discharge the ink from the ejection opening.

[Patent Document 1] Japanese Patent Laid-Open No. 2000-118000

[Patent Document 2] Japanese Patent Laid-Open No. 2001-138545

[Patent Document 3] Japanese Patent Laid-Open No. 2004-284189

DISCLOSURE OF THE INVENTION

However, there are several problems as described below in the conventional type of inkjet printing apparatuses having a pressure generating unit.

Various types of pumps such as a tube pump, a cylinder pump, a bellows pump, or a diaphragm pump are generally used as the pressure generating unit. When any of the pumps is driven by a general drive mechanism, changes in the generated pressure are not in the direct proportional relation to a driving time as expressed by a linear expression, but in the step-by-step or other irregular states, which means that pulsation inevitably occurs.

For instance, the tube pump has a member having a curved surface along which at least a portion of a tube, the portion being flexible, is aligned and supported thereon, a roller capable of pressing the flexible tube to the member, and a rotatable roller support member for supporting the roller. In this configuration, when the roller support member is rotated in a predetermined direction, the roller moves on the curved surface while pressing (squeezing) the flexible tube. When the negative pressure generated in association with the operation described above is applied to the ejection face, ink can be sucked from the ejection opening. In the tube pump having the configuration as described above, even when a rotational angular speed of a motor or the like as a driving power source or the roller support member connected to the motor or the like is constant, a rate of changes in a pressure p against a time t ($\delta p/\delta t$) changes.

On the other hand, when ink is filled in a printing head, or when clogging caused by fixation of ink or for other reasons is to be resolved, a pressure larger than a predetermined value or an ink discharge rate higher than a predetermined rate is required. In this case, however, when the negative pressure is too high, an ink supply rate in an ink supply path from an ink tank up to a nozzle is inadequate, and sometimes ink supply can not be performed smoothly, which is disadvantageous. Although an quantity of discharge ink is in proportion to a generated pressure, but in a case of the tube pump described above, even if the roller squeezes it by only by a constant angle, the quantity of discharged ink varies according to a phase of the roller. Because of the phenomenon, there occur the troubles, for instance, that ink is insufficiently filled, that the cleaning capability becomes unstable, or that the ink is excessively consumed and the running cost disadvantageously increases.

For the reasons as described above, for optimizing the processing performed in the apparatus, high precision control is required for a pressure generated by the pressure generating unit and a discharge rate of ink.

To overcome this problem, in the conventional technology, a mechanical sensor is provided for detecting a phase of the pump, and operations of the pump are controlled according to the detected pump phase. For instance, in the tube pump, a flag is provided in a rotary section of the pump for detecting a phase of a roller, and also a unit for detecting a roller phase with a sensor such as a photo interrupter is provided therein. Therefore, in the inkjet printing apparatus based on the conventional technology, the cost increases and size of the apparatus becomes larger in association of provision of a specific pump phase detecting unit.

An object of the present invention is to make stable a performance of a pressure generating unit without the need of providing a specific detecting unit such as a mechanical sensor.

To achieve the object described above, the present invention provides an inkjet printing apparatus using a printing head for ejecting ink and having a pressure generating unit for generating a pressure to perform a processing to move ink by applying the pressure to the printing head, the inkjet printing apparatus comprising:

a DC motor as a driving source for the pressure generating unit;

a control unit for controlling the DC motor to maintain a rotating speed at a constant level;

a detecting unit for detecting an electric power applied to the DC motor for the control; and a determining unit for determining a phase of the pressure generating unit based on a result of the detection.

Furthermore, the present invention provides a method of controlling an inkjet printing apparatus using a printing head capable of ejecting ink and also comprising a pressure generating unit for generating a pressure to perform a processing to move the ink by applying the pressure to the printing head and a DC motor as a driving source for the pressure generating unit, the method comprising the steps of:

controlling the DC motor so that the rotating speed is kept constant;

detecting an power applied to the DC motor for the control; and determining a phase of the pressure generating unit based on a result of the detection.

The present invention employs a control system in which an electric power supplied to a motor is changed according to load fluctuations and a phase of a pressure generating unit (pump) is determined based on a result of detection of the supplied power. With the configuration described above, it is possible to manage a pressure generated by the pressure generating unit and a discharge rate of ink with a low-cost configuration not requiring any specific unit for detection.

BEST MODE FOR CARRYING OUT THE INVENTION

The present invention is described in detail below with reference to the drawings.

First Embodiment

Figure 1:
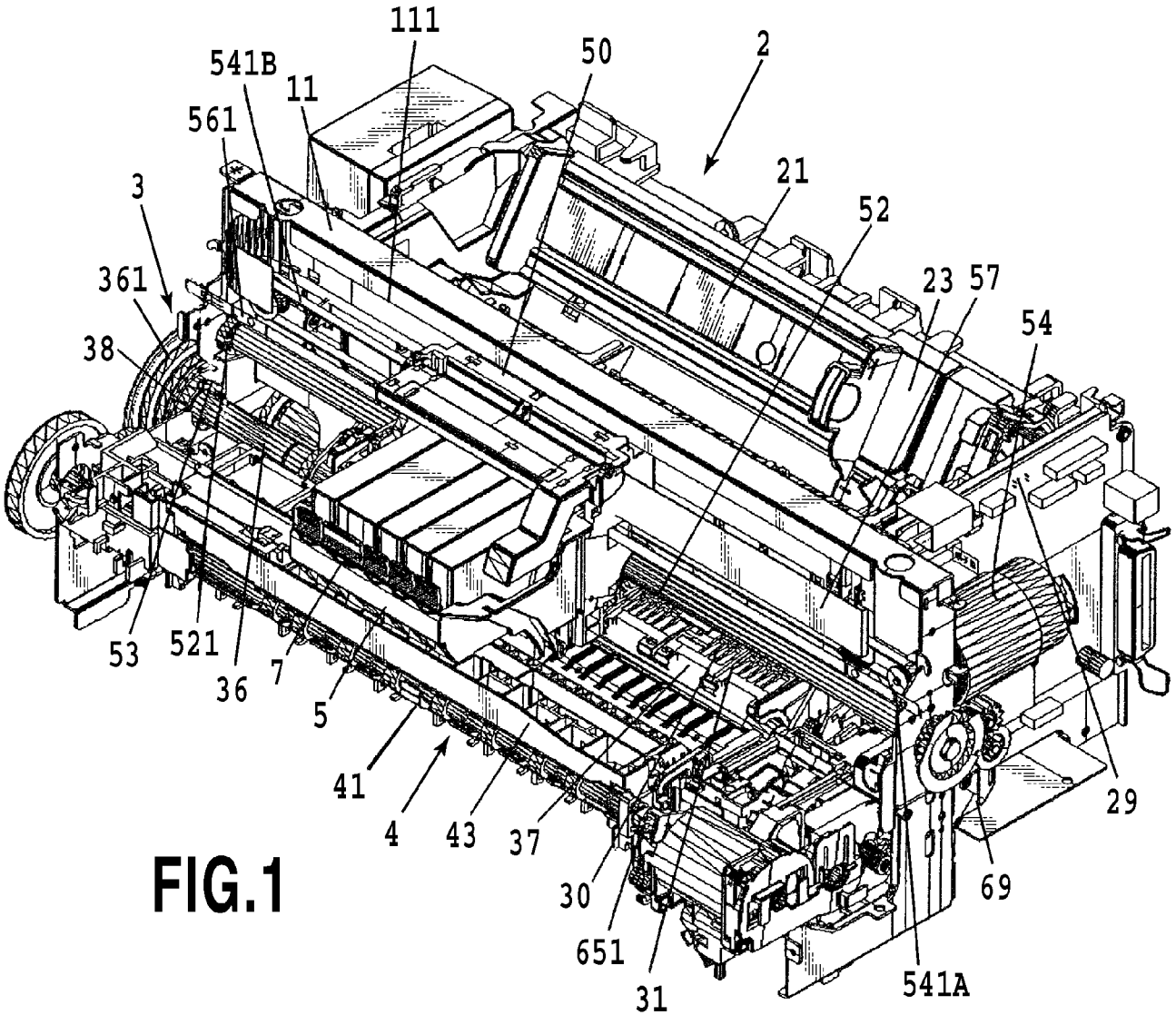
FIG. 1 is a view illustrating an inkjet printing apparatus according to a first embodiment of the present invention.
Figure 2:
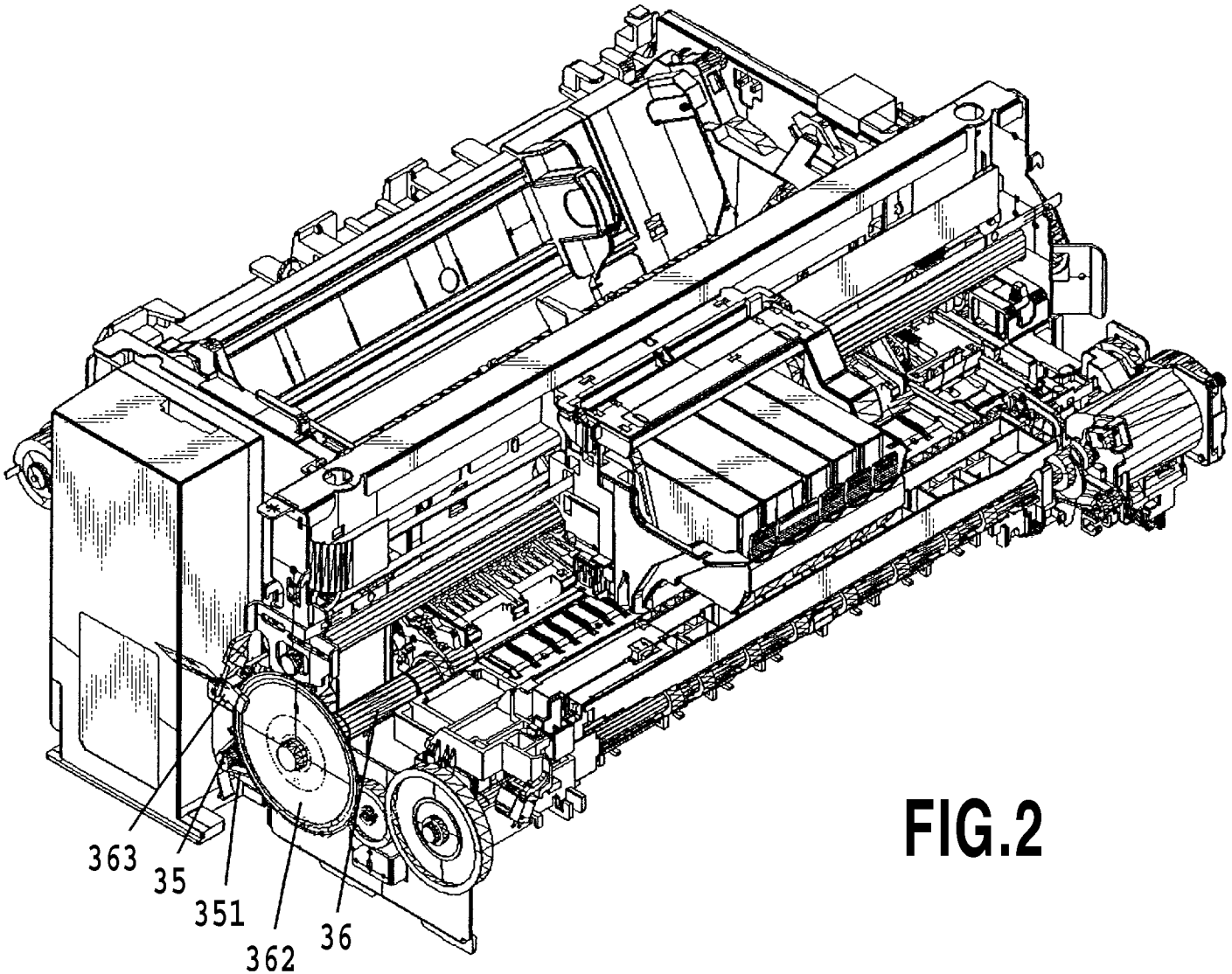
FIG. 2 is a perspective view illustrating the inkjet printing apparatus according to the first embodiment of the present invention when viewed in a direction different from that in FIG. 1.
Figure 3:
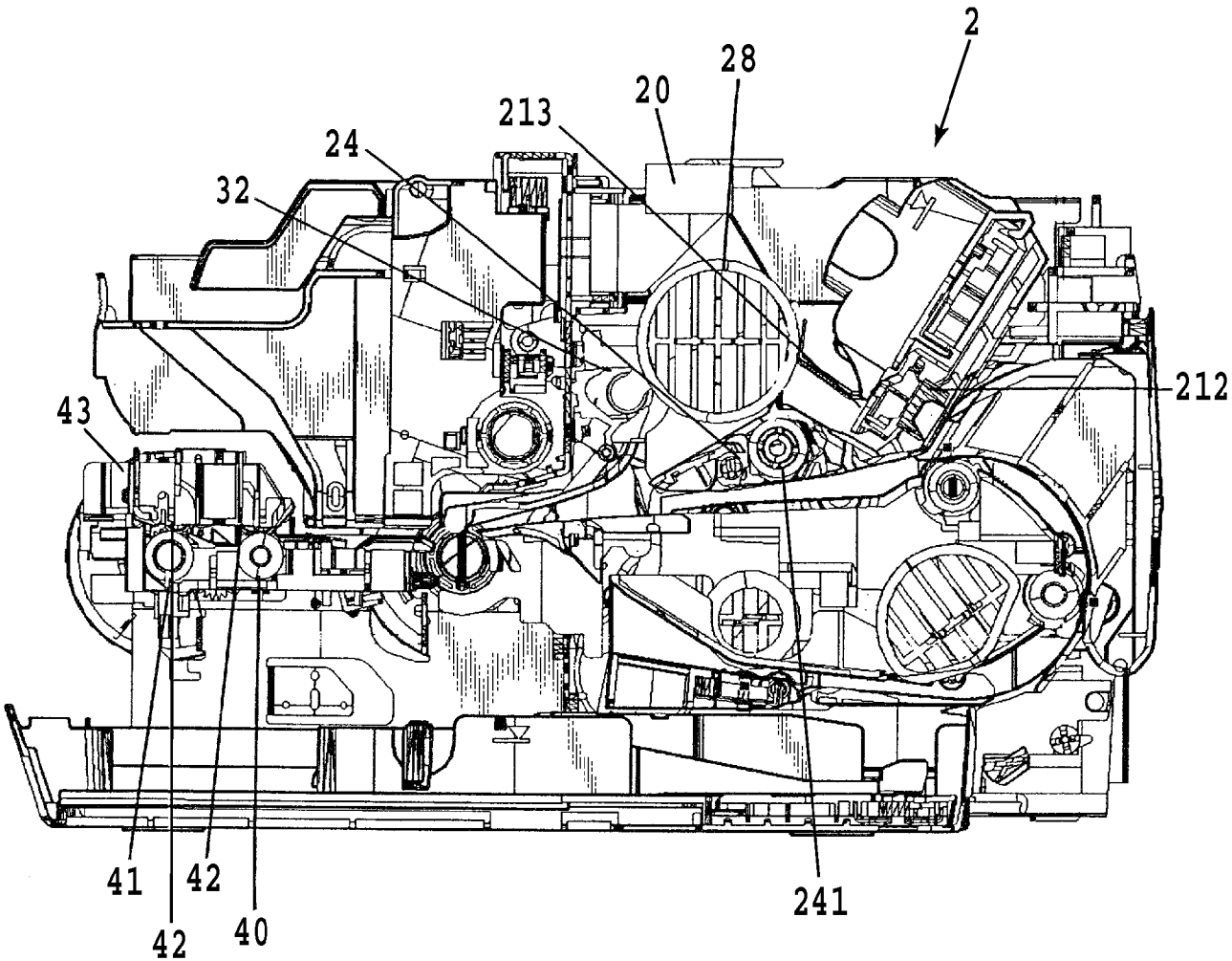
FIG. 3 is a cross-sectional view of the inkjet printing apparatus according to the first embodiment.
Figure 4:
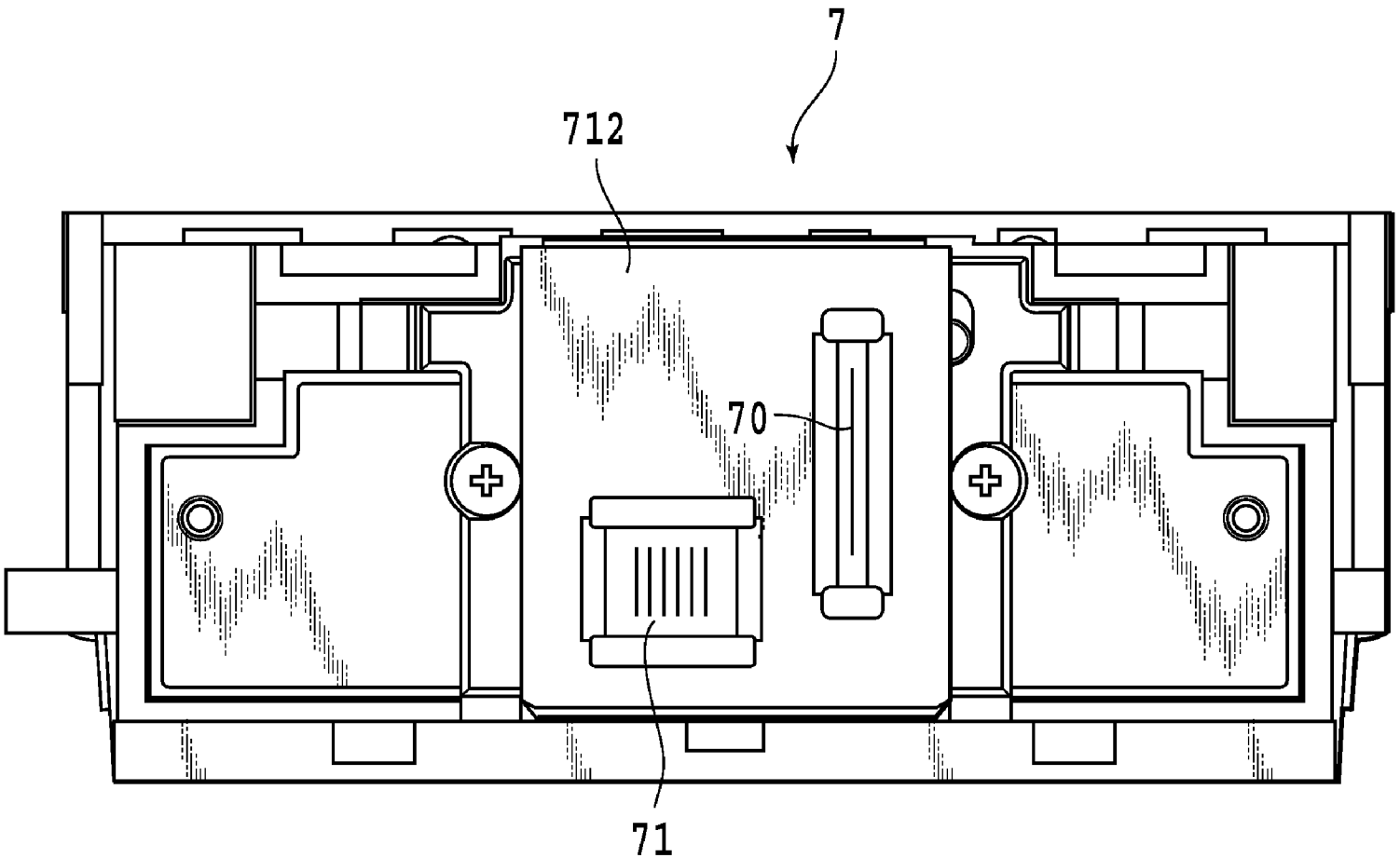
FIG. 4 is a view illustrating a printing head applied in the first embodiment when viewed from the ejection face side.
Figure 5:
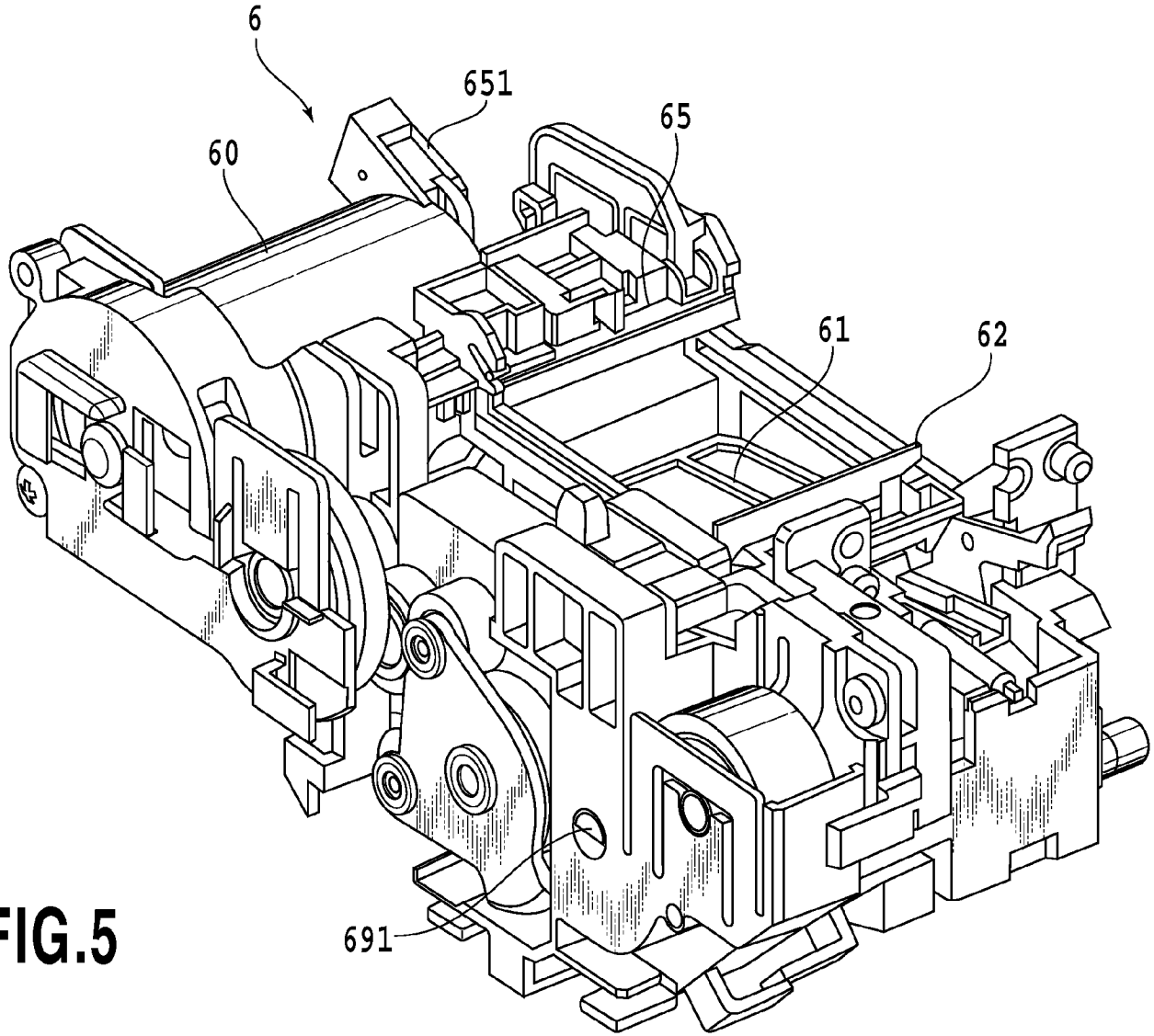
FIG. 5 is a perspective view illustrating a cleaning unit in the printing apparatus according to the first embodiment.
Figure 6:
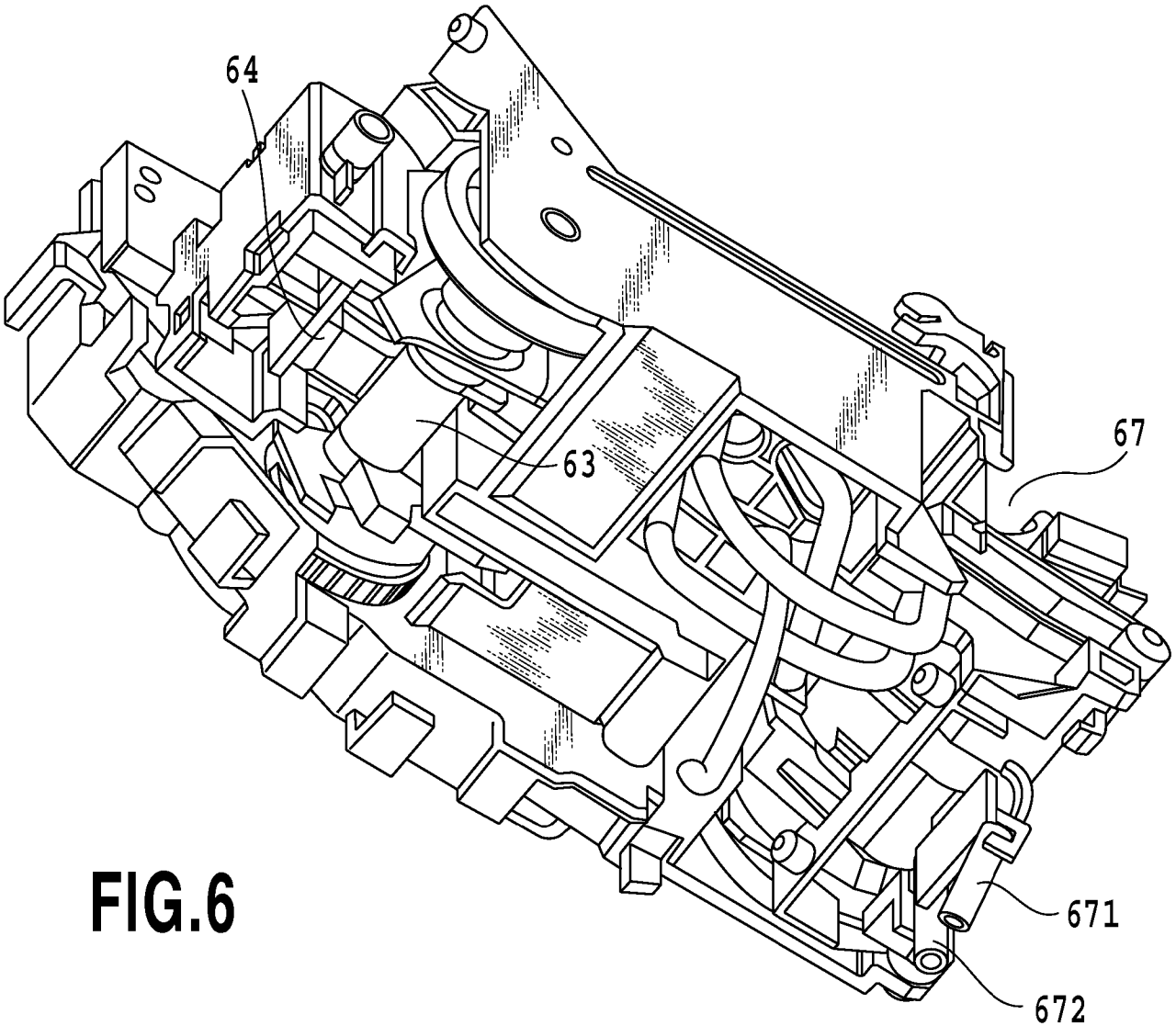
FIG. 6 is a perspective view of the cleaning unit according to the first embodiment viewed in a direction different from that in FIG. 5.
Figure 7:
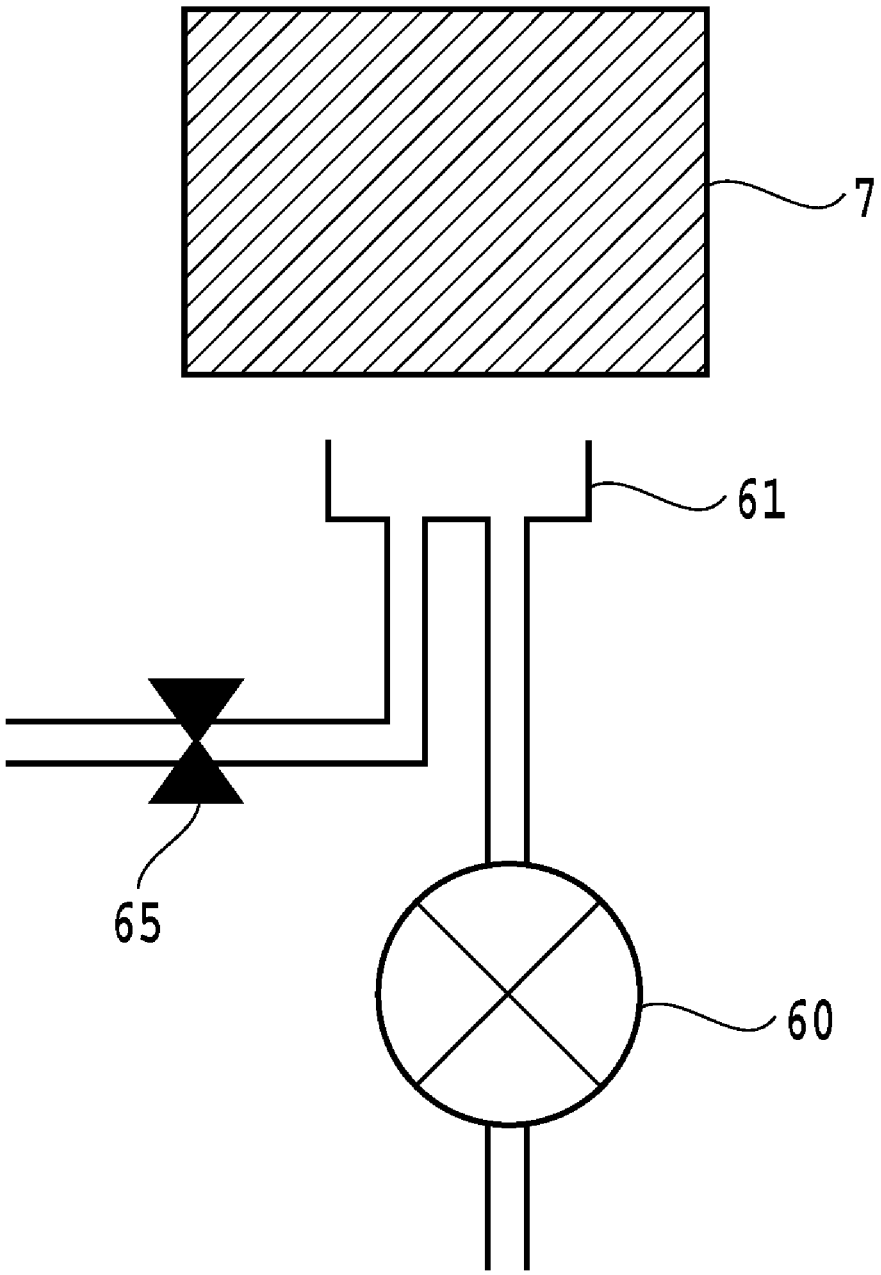
FIG. 7 is a view schematically showing an ink suction mechanism in the cleaning unit in the printing apparatus according to the first embodiment.
Figure 8:
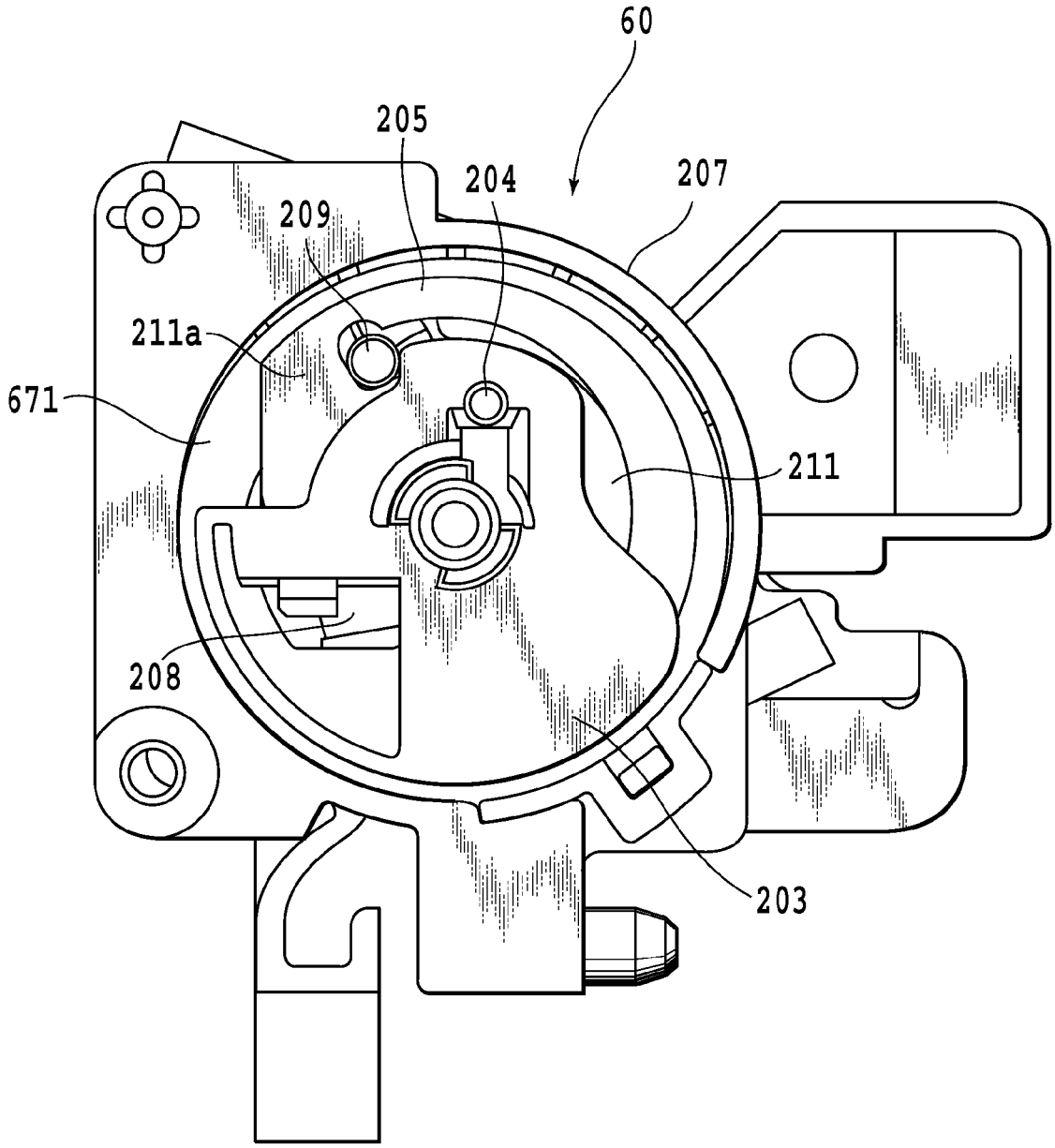
FIG. 8 is a cross-sectional view illustrating a pump of the cleaning unit in the printing apparatus according to the first embodiment.
Figure 9:
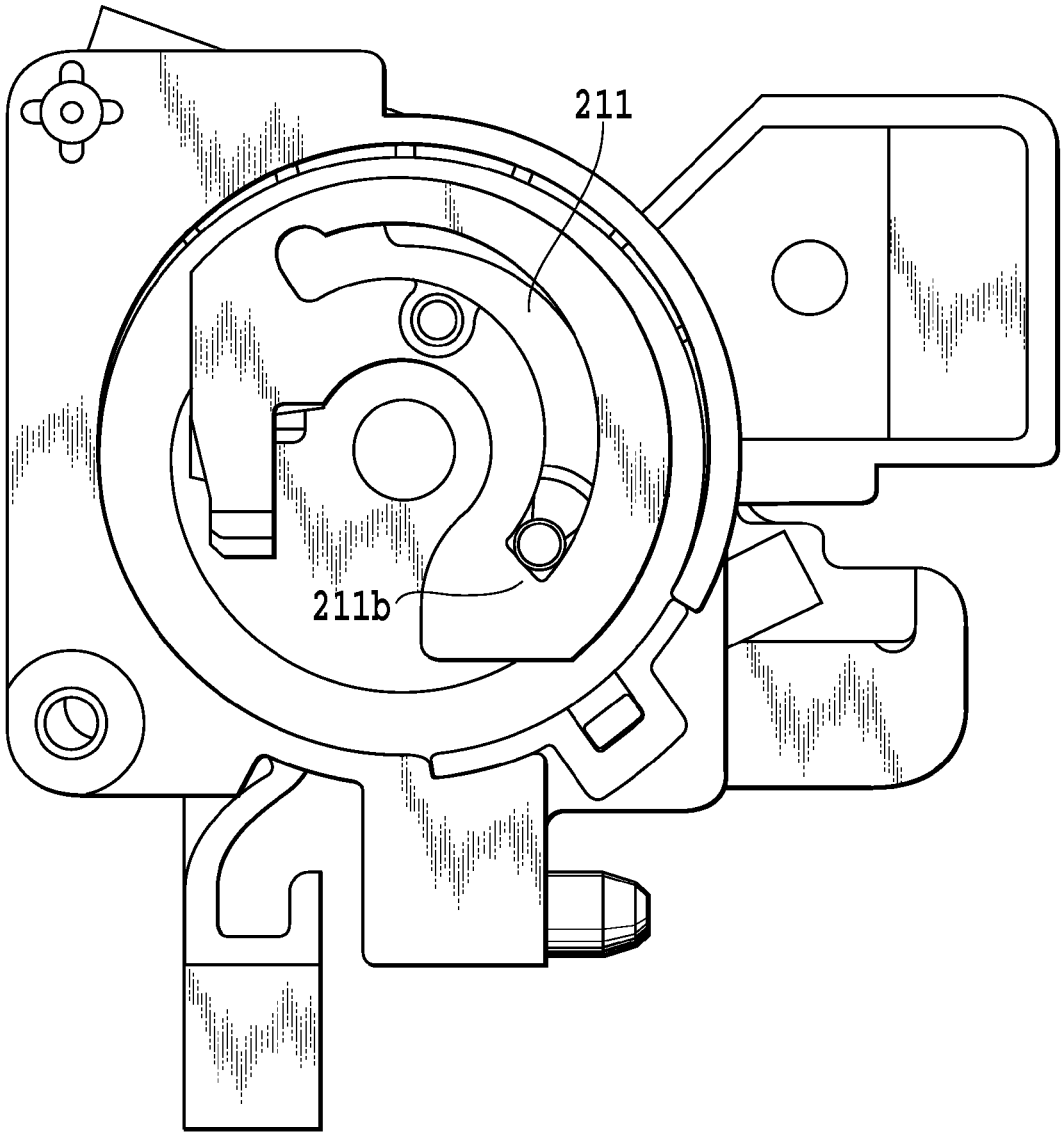
FIG. 9 is a cross-section view illustrating the pump of the cleaning unit in the printing apparatus according to the first embodiment.
Figure 10:
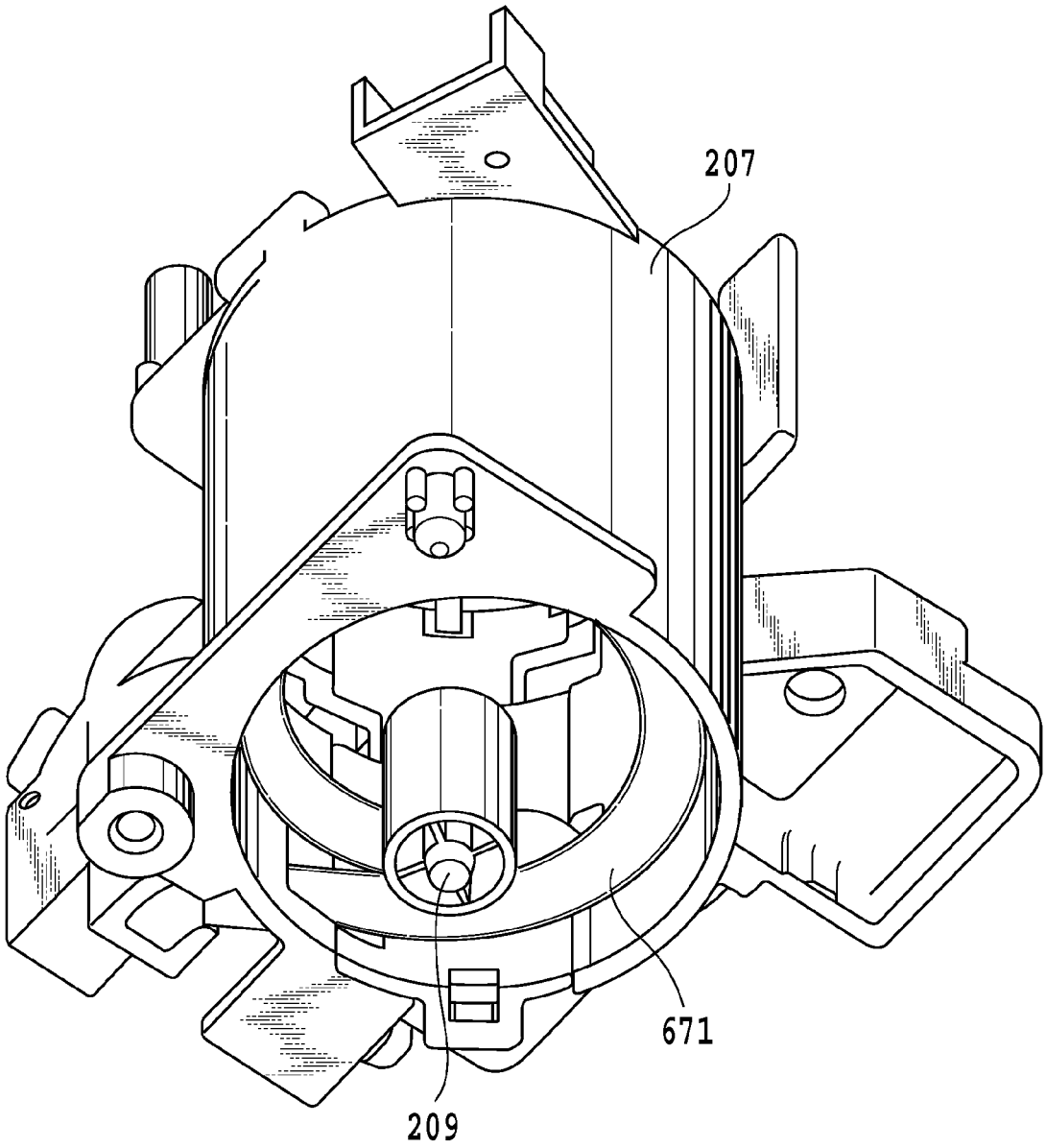
FIG. 10 is a perspective view of the pump of the cleaning unit in the printing apparatus according to the first embodiment.
Figure 11:
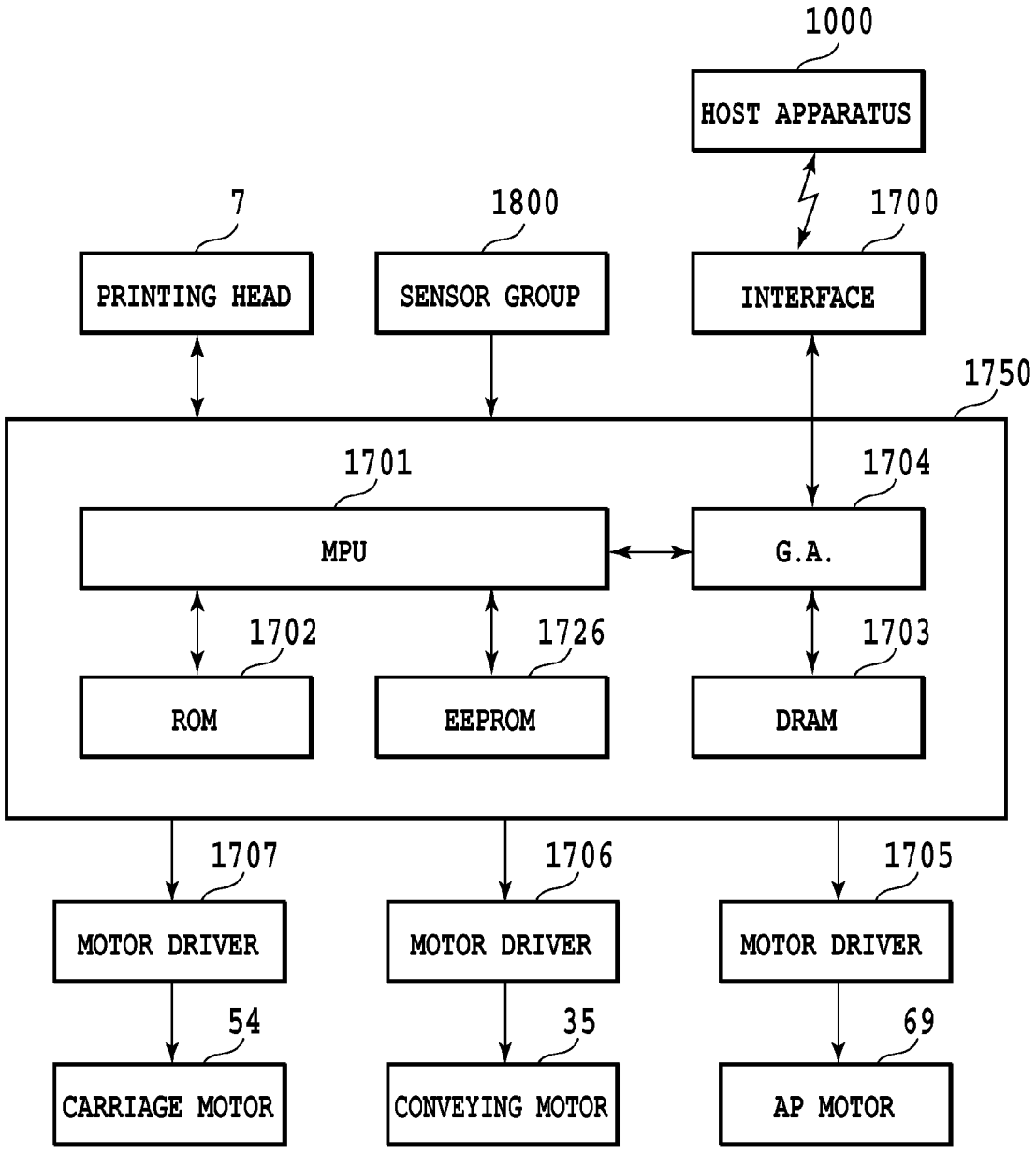
FIG. 11 is a block diagram illustrating a configuration of a control system in the printing apparatus according to the first embodiment.
Figure 12:
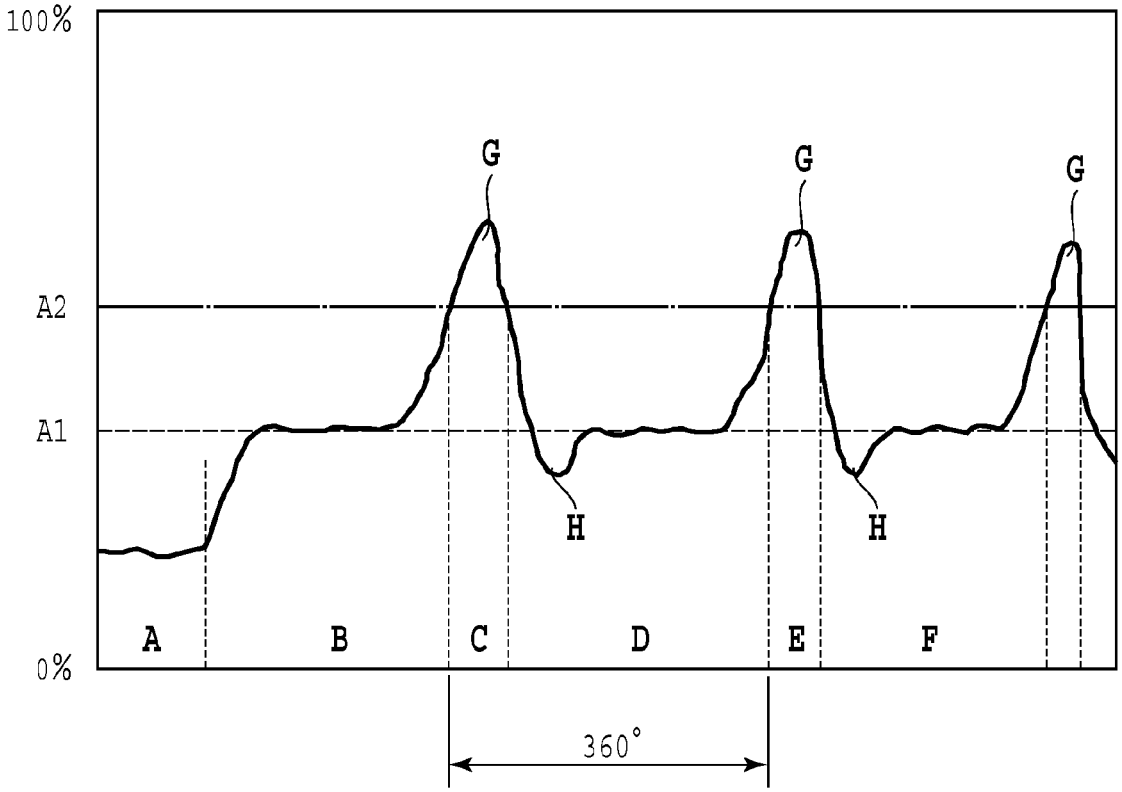
FIG. 12 is a graph showing a current waveform when the pump according to the first embodiment is driven by a DC motor.
Figure 13:
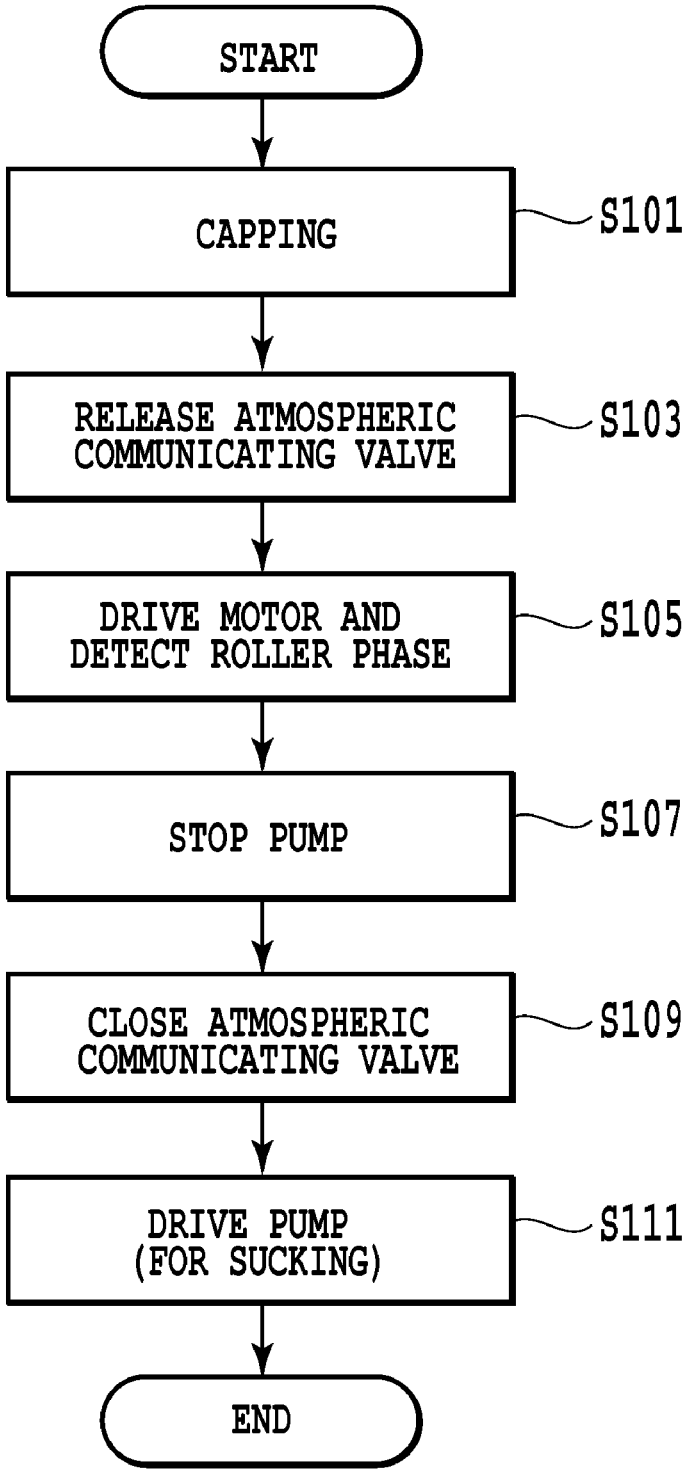
FIG. 13 is a flowchart showing a control sequence for driving the pump according to the first embodiment.

An inkjet printing apparatus (also referred to simply as "printing apparatus" hereinafter) according to a first embodiment of the present invention with reference to FIG. 1 to FIG. 12. FIG. 1 and FIG. 2 are views illustrating the printing apparatus according to the first embodiment viewed in different directions respectively, and FIG. 3 is a lateral cross-sectional view of the printing apparatus. FIG. 4 is a view illustrating a printing head applied in the embodiment viewed from the ejection face side. FIG. 5 and FIG. 6 are perspective views illustrating a cleaning unit in the printing apparatus according to the first embodiment in different directions respectively; FIG. 7 is a view schematically showing an ink suction mechanism in the cleaning unit; FIG. 8 and FIG. 9 are cross-sectional views each showing a pump in the cleaning unit; and FIG. 10 is a perspective view illustrating the pump. FIG. 11 is a block diagram illustrating an example of a configuration of a control system in the printing apparatus according to the first embodiment; FIG. 12 is a graph showing a current waveform when a pump as a pressure generating unit is driven by a DC motor; and FIG. 13 is a flowchart illustrating a control sequence for driving the pump.

Mechanical Configuration

The printing apparatus 1 according to the embodiment has a paper feed section 2, a paper conveying section 3, a carriage section 5, a paper discharge section 4, a cleaning section 6, a printing head 7, and an exterior and electric section.

(A) Paper Feed Section

The paper feed section 2 has a pressure plate 21 on which sheet-like printing media (referred to as "sheets" hereinafter) are stacked, a paper feed roller 28 for feeding the sheet, a separation roller 241 for separating the sheets one by one, and other components are mounted on a base 20. Although not shown in the figure, a paper feed tray for holding the stacked sheets is mounted on or around the base 20.

The paper feed roller 28 feeds the sheet in cooperation with the separation roller described below. A driving force is transmitted to the paper feed roller 28 from a DC motor 69 (which is commonly used with a cleaning section described below. This component is referred to as an AP motor hereinafter) provided in the paper feed section 2 via a transmission mechanism including a gear train. A gear in the transmission mechanism is provided with an AP encoder for detecting a rotational speed so that the paper feed roller 28 is controlled in the closed loop according to a result of the detection. Namely, the PWM value control for a current is effected for controlling a power supply to the AP motor, and a rotational speed of the paper feed roller 28 is controlled according to the PWM value.

A movable side guide 23 is movably provided on the pressure plate 21 to restrict a stacking position for the sheets. The pressure plate 21 can pivot around a rotary shaft connected to the base 20, and is urged toward the paper feed roller 28 by a pressure plate spring 212. Provided at a section of the pressure plate 21 facing against the paper feed roller 28 is a separation sheet 213 made of a material having a high friction coefficient for preventing a plurality of the sheets from being fed together when a number of the stacked sheets becomes smaller. The pressure plate 21 can be contacted to and detached from the paper feed roller 28 by a pressure plate cam not shown in the figures.

Furthermore, on the base 20, a separation roller holder 24 with the separation roller 241 made of rubber or the like for separating the sheets one by one is rotatably provided around a rotary shaft provided on the separation base 20. The separation roller holder 24 is urged toward the paper feed roller 28 by a separation roller spring not shown. A clutch spring (not shown) is attached to the separation roller 241, and a load larger than a predetermined value is applied, a section to which the separation roller 241 is attached can rotate. In addition, the separation roller 241 can be abutted on or separated from the paper feed roller 28. Positions of the pressure plate 21, the separation roller 241, and other components are detected by an automatic sheet-feed sensor 29 (referred to as ASF sensor hereinafter).

(B) Paper Conveying Section

The paper conveying section 3 is mounted on a chassis 11 made of an upwardly bent plate The paper conveying section 3 has a conveying roller 36 for conveying the sheet and a PE sensor 32. A surface of a metal shaft of the conveying roller 36 is coated with microparticles of ceramics, and metallic portions at both ends of the shaft are supported by bearings 38 attached to the chassis 11.

A plurality of pinch rollers 37 are in contact with the conveying roller and moves in association with movement of the conveying roller 36. The pinch roller 37 is held by a pinch roller holder 30, and when the pinch roller holder 30 is urged by a pinch roller spring 31, the pinch roller 37 is pressed to the conveying roller 36, thus a force for conveying the sheet being produced. A rotary shaft of the pinch roller holder 30 is supported by a bearing mounted on the chassis 11, and rotates around the bearing.

The conveying roller 36 is driven by transmitting rotation of a conveying motor 35 which is a DC motor via a timing belt 351 to a pulley 361 provided on a shaft of the conveying roller 36. Furthermore, provided on the shaft of the conveying roller 36 is a code wheel 362 having markings thereon with the pitch of 150 to 300 lpi (line/inch). On the other hand, an encoder sensor 363 for reading the marking is attached to the chassis 11 at a position adjoining the code wheel 362. With the configuration described above, a conveying amount of the sheet by the conveying roller 36 can be detected.

(C) Printing Head

An area in the downstream side in a direction in which the sheet is conveyed by the conveying roller 36 is scanned by the printing head 7 for forming an image based on image information.

FIG. 4 is a view illustrating the printing head 7 applied in this embodiment when viewed from the ejection face side. In the configuration shown in the figure, there are provided an ejection portion 70 for ejecting black ink containing, for instance, pigment as colorant, and an ejection portion 71 for ejecting inks for three colors of yellow, magenta, and cyan. The color inks contain dyes as colorants.

Ink tanks for the inks are mounted in the printing head 7 capable of ejecting each of the inks. The ink tanks can be exchanged with new ones respectively. The printing head 7 may have an element (heater) for generating thermal energy to cause film boiling of the ink as an energy used to eject the ink. In association with pressure changes generated by growth or shrinkage of a bubble caused by the film boiling, the ink is ejected from a ejection opening 70 of the printing head 7 to form an image on a sheet.

(D) Carriage Section

The carrier section 5 has a carriage 50 on which the printing head 7 is mounted. The carriage 50 is supported by a guide shaft 52 extending in a direction perpendicular to the direction in which the sheet is conveyed, and a guide rail 111 holding a rear end of the carriage 50 for maintaining a clearance between the printing head 7 and the sheet. The guide shaft 52 is mounted to the chassis 11, while the guide rail 111 may be formed integrally with the chassis 11.

The carriage 50 is driven by the carriage motor 54 mounted on the chassis 11 via the timing belt 541. The timing belt 541 is stretched between a pulley 542A attached to a shaft of the motor 54 provided at an end of the scanned area and an idle pulley 542B provided at another end of the scanned area. Furthermore, a code strip 561 having the marking with the pitch of 150 to 300 lpi is provided in parallel to the timing belt 541. On the other hand, an encode sensor not shown for reading the marking is mounted on the carriage 50. With the components, it is possible to detect a position of the carriage 50 or the printing head 7 in the scanning direction. In addition, a flexible board 57 for transmitting signals from an electric board not shown to the printing head 7 is provided on the carriage 50.

In the configuration described above, when an image is to be formed on the sheet, the rollers 36 and 37 convey the sheet for setting at a line on which the image is to be formed (to a position in the conveying direction of the sheet). Then, the carriage 50 is moved (for scanning) by the carriage motor 54, with the printing head 7 facing against the potion at which the image is to be formed. In this process, the printing head 7 ejects ink to the sheet according to signals transmitted from an electric board provided on the carriage, thus an image being formed.

(E) Paper Discharge Section

The paper discharge section 4 has two paper discharge rollers 40, 41, spurs which contact the rollers 40, 41 with a predetermined constant pressure respectively and rotate in association with rotation of the paper discharge rollers 40 and 41, a gear train for transmitting motion of the conveying roller 36 to the paper discharge rollers 40 and 41.

The paper discharge rollers 40 and 41 are attached to a platen 34. A driving force to the paper discharge roller 41 is transmitted from the paper discharge roller 40 via an idle gear.

The spur 42 is a body in which a circular and thin plate made of, for instance, SUS with a plurality of convex portions provided on the circumferential portion thereof and a resin portion are integrated. A plurality of spurs 42 are attached to a spur holder 43. This attachment is done by a spur spring provided in the rod-like state. A spring force of the spur spring makes it possible for the spurs 42 to contact the paper discharge rollers 40 and 41 with a predetermined constant pressure respectively. With the configuration described above, the spurs 42 can rotate following rotations of the two paper discharge rollers 40 and 41.

With the configuration described above, the sheet with the image formed thereon in the carriage section 5 is held in a nip portion of the paper discharge roller 41 and the spur 42 and is conveyed or discharged.

(F) Cleaning Section

The cleaning section 6 in this embodiment comprises, as shown in FIG. 5 and FIG. 6, a pump 60 as a pressure generating unit, a cap 61 which can face against or contact with a ejection face of the printing head 7, and a blade 62 for wiping the ejection face of the printing head 7.

A driving force for the cleaning section 6 is transmitted from the AP motor 69 via a drive gear train. The cleaning section 6 is so constructed that the pump 60 works when a one-way mechanism provided in the drive gear train rotates in one direction, and a main cam 63 rotates to move the blade 62 or to lift up/down the cap 61 when the one-way mechanism rotates in another direction. Cams or arms provided at appropriate portions of the blade 62 and the cap 61 are connected to the main cam 63, so that the blade 62 and the cap 61 can carry out respective operations when the main cam 63 operates. A position of the main cam 63 can be detected by a position detector sensor 64 such as a photo interrupter.

When printing an image, ink droplets ejected from the ejection opening include not only main ink droplets involving in the printing operation, but also fine ink droplets. The fine ink droplets may be adhered around the ejection opening on the ejection face. Furthermore, also when ink is leaked from the printing head during the sucking operation described below, the ink is often adhered around the ejection opening. The adhered ink pulls the ejected main ink droplets to cause deflection of the ink ejecting direction, namely to prevent the main ink droplets from going straight ahead. In this embodiment, the blade 62 is provided as a component of the cleaning unit to overcome the problem. The blade 62 moves in a direction perpendicular to the scanning direction of the carriage 5 while the cap 61 is moving downward, and slidably contacts the ejection face to clean (wipe) the ejection face of the printing head 7. It is to be noted that the blade 62 may have two blade sections for wiping two ejection portions respectively and a blade section for wiping the entire surface including two ejection portions.

FIG. 7 is a view schematically showing a sucking mechanism including the cap and the pump as another component of the cleaning unit. The cap 61 in this embodiment has two cap sections, and performs capping for portions corresponding two ejection portions 70 and 71 on the ejection face when positioned at the lifted position, and also can prevent increase of viscosity of ink or fixation and drying of the ink when a printing operation is not being performed. Furthermore, in the capping state, an operation for filling ink into the printing head 7 from an ink tank in the initial stage, an operation for removing clogging or the like can be performed by sucking. Namely, sucking can be performed from a ejection opening of the printing head 7 by generating a negative pressure inside the cap 61 closely contacted to a ejection face of the printing head 7 by the pump 60. The cap 61 is set at a descended position during the printing operation for evading interference with the printing head 7. Furthermore, in the state where the cap 61 is set at the descended position and the printing head 7 is located at a position facing against the cap 61, it is possible to make the printing head 7 execute an ejecting operation (preliminary ejection) by predetermined times.

The ink stored in the cap 61 because of the sucking or preliminarily ejecting operation as described above can be transferred to an wasted ink storage section not shown via two sucking tubes 671 and 672 by activating the pump 60.

In FIG. 7, the reference numeral 65 denotes a valve for communicating a space inside the cap to the atmosphere according to the necessity. Transmission and control of a driving force for opening or closing the valve 67 may be performed in response to rotation of the paper discharge roller 41. In this embodiment, two systems of the cap section and the tube are provided for the two ejection portions 70 and 71, and the atmospheric communicating valve 67 is provided in each of the two systems. Because of the configuration, by opening or closing the valves in the two atmospheric communicating valves 67 in the two systems according to the necessity, batch suction from both of the ejection portions 70 and 71 and individual suction from either one of the two ejection portions can be selected and carried out according to the necessity. Namely, the negative pressure generated by the pump 60 is directly applied to ink ejection nozzle arrays 70 or 71 via the cap 61 closely contacted to the printing head 7, but by opening both or either one of the atmospheric communicating valves 67, it is possible to effect the state in which ink is not sucked from the ejection opening array 70 and/or the ejection opening array 71 even when the pump is driven. Open/close positions of the atmospheric communicating valves 67 are detected by an atmospheric communicating valve-position detecting sensor 651 (FIG. 5).

A specific configuration and operations of the pump 60 as a unit for generating a negative pressure is described below with reference to FIG. 8 to FIG. 10. Although the two system of the cap section and the tube are provided for the two ejection portions 70 and 71 in this embodiment, but only one system is illustrated in the figures for convenience in description. Another system is identical to the one described below, and it is assumed in the following description that phases of pumps in the two system are identical.

A roller holder 205 is supported on a roller wheel 203 which rotates when driven by the AP motor 69. A roller 209 for squeezing the tube is supported by the roller holder 205 and is urged in the radial direction to press the tube by a compression spring 208 provided between the roller wheel 203 and the roller holder 205.

A cam section 211 is formed for moving the roller 209 in the radial direction and also for controlling a position of the roller 209 in the radial direction. An end portion 211*a* of the cam section 211 controls the roller 209 at a position in the radial direction at which the roller 209 presses the tube to made internal walls of the tube closely contact each other (so that the roller 209 squeezes the tube to generate a negative pressure) (Refer to FIG. 8). The other end 211*b* of the cam section 211 controls the roller 209 at a position at which the roller 209 abuts the tube but the internal walls thereof do not contact each other closely (the tube is not completely pressed nor sealed up) (Refer to FIG. 9). Therefore, when the roller wheel 203 is rotated in the counterclockwise direction in FIG. 8 (when the roller holder 205 is rotated in the counterclockwise direction coaxially with the rotary shaft of the roller wheel 203), the roller 209 relatively moves from the position 211*a* of the cam section 211 of the roller holder 205 to a position 211*b* to release the sealed state of the internal walls of the tube. In association with the movement of the roller 209, a space inside the cap 61 is communicated via the tube to the atmosphere. On the other hand, when the roller wheel 203 is rotated in the clockwise direction in FIG. 9 (when the roller holder 205 is rotated in the clockwise direction coaxially with the rotary shaft of the roller wheel 203), the roller 209 relatively moves from the position 211*b* of the cam section 211 of the roller holder 205 to the position 211*a* to effect the sealed state inside the tube. When the roller wheel 203 rotates, the sucking operation can be carried out. It is to be noted that the roller wheel 203 and the compression spring 208 shown in FIG. 8 are omitted in FIG. 9 for simplification.

It is also to be noted that a tube 671 is arranged in a pump base 207 by 360 degrees or more. Namely, there are two positions where the same sucking tube is pressed by the roller 209 in a portion of the pump base 207.

Configuration of a Control System

A configuration of a main portion of the control system in the printing apparatus having the configuration as described above and control operations thereby are described below with reference to FIG. 11 to FIG. 13.

In FIG. 11, the reference numeral 1700 denotes an interface, and the interface 1700 receives printing signals including commands or image data sent from a host apparatus 1000 such as a computer, a digital camera, a scanner, and also transmits status information for the printing apparatus to the host apparatus 1000 according to the necessity.

Reference numeral 1750 denotes a control section, which has the following sections. In the control section 1750, reference numeral 1701 denotes an MPU, which controls each section of a printer according to a control program corresponding to the processing sequence described in reference to FIG. 13 and required data stored in a ROM 1702. Reference numeral 1703 denotes DRAM for storing therein various types of data. Reference numeral 1704 denotes a gate array (G.A) for controlling supply of print data to the printing head 7, and the gate array 1704 also controls data transfer among the interface 1700, the MPU 1701, and the DRAM 1703. Reference numeral 1726 is an nonvolatile memory such as an EEPROM for storing therein required data when a power for the printing apparatus is OFF.

Reference numerals 1705, 1706, and 1707 denote motor drivers for driving the AP motor 69, the conveying motor 35, and the carriage motor 54 respectively. Especially, the AP motor, which is a DC motor, is under the current PWM control to keep the rotational speed constant, and the control circuit may be included in the motor driver 1705. Furthermore, it is allowable for the motor driver to include a circuit for detecting changes in the current values associated with fluctuations in load.

Furthermore, the control section 1750 transmits print data to the printing head 7. In addition, required sensors 1800 are connected to the control section. In this embodiment, however, a sensor for detecting a phase of a pump is not provided.

As described above, a source of a driving force for the pump 60 in this embodiment is the AP motor which is a DC motor. Therefore, in this embodiment, to keep a rotational speed of the AP motor constant according to the detection result by the AP encoder in a state a drive voltage is constant, the current PWM control is employed for changing an applied power in response to load fluctuations.

FIG. 12 is a graph showing changes in the PWM values when the roller 209 is located and rotated within the pump at a position where internal walls of the tube closely contact each other.

In this graph, area A indicates the state in which the roller 209 moves from the position 211*b* where internal walls of the tube are separated from each other to the position 211*a* where the internal walls of the tube closely contact each other.

Area B indicates the state in which the roller 209 starts squeezing the tube 671, and the PWM value becomes larger rapidly to keep the rotational speed constant in response to increase of the load.

Area C indicates the state in which the roller 209 squeezes two portions of the tube. In this state, a deforming rate of the tube becomes smaller as compared to that in the area B in which the roller 209 squeezes only one portion of the tube, and at the same time a deflection rate of the compression spring 208 increases, so that a rotating load increases and also the PWM value becomes larger (state G).

In area D, the roller 209 rapidly returns from the state where the roller 209 squeezes two portions of the tube to the state where the roller 209 squeezes only one portion of the tube, so that the rotating load rapidly drops from the elevated state in state G to a level equivalent to that in area B. In this step, the PWM value once overshoots to a value lower than a value equivalent to that in area B (state H), and then returns to the value equivalent to that in area B.

Area E and area F indicate phases advanced from those in area C and area D by 360 degrees respectively, and the states are equivalent to those in area C and area D.

Therefore, by setting the PWM value when the roller 209 squeezes only one portion of a tube as shown in FIG. 12 to A1 and also setting the PWM value when the roller 209 squeezes two portions of the tube to A2, it is possible to perform phase detection. Namely, in this embodiment, it is possible to manage a generated pressure and a discharge rate extremely precisely by identifying a phase of the roller or the pump without the need of using a special sensor or the like.

To further improve the precision, the configuration may be employed in which a phase of the roller or the pump is determined when a point where a PWM value higher than the threshold A2 is generated (state G) is detected twice with a phase lag of about 360 degrees, namely when both of area C and area E in FIG. 12 are detected. With the configuration, it is possible to more accurately detect a point at which the roller 209 pressed two portions of a tube.

Furthermore, the smallest value of the current PWM value associated with rapid increase in a rotating load (state H) appears immediately after the largest value of the PWM value higher than the threshold A2, and therefore the same effect can be obtained by detecting the smallest value of the current PWM value to determine a phase of the roller or the pump.

A representative control sequence for driving the pump is described below with reference to FIG. 13.

At first, in step S101, the cap 61 is closely contacted to a ejection face of the printing head 7 for capping, and in step S103, the atmospheric communicating valve 65 is opened. Then in step S105, the pump is driven, and high load phases at two areas (area C and area E) associating a phase lag of about 360 degrees are detected as described above to determine a phase of the roller or the pump. Then rotation of the roller is stopped at a desired phase in step S107 based on the determined phase. Then in step S109, the atmospheric communicating valve 65 is closed, and in step S111, the roller is rotated by a predetermined angle while pressing the tube for cleaning (sucking).

It is to be noted that the control sequence can also be applied in each of the embodiments described below.

Second Embodiment

Figure 14:
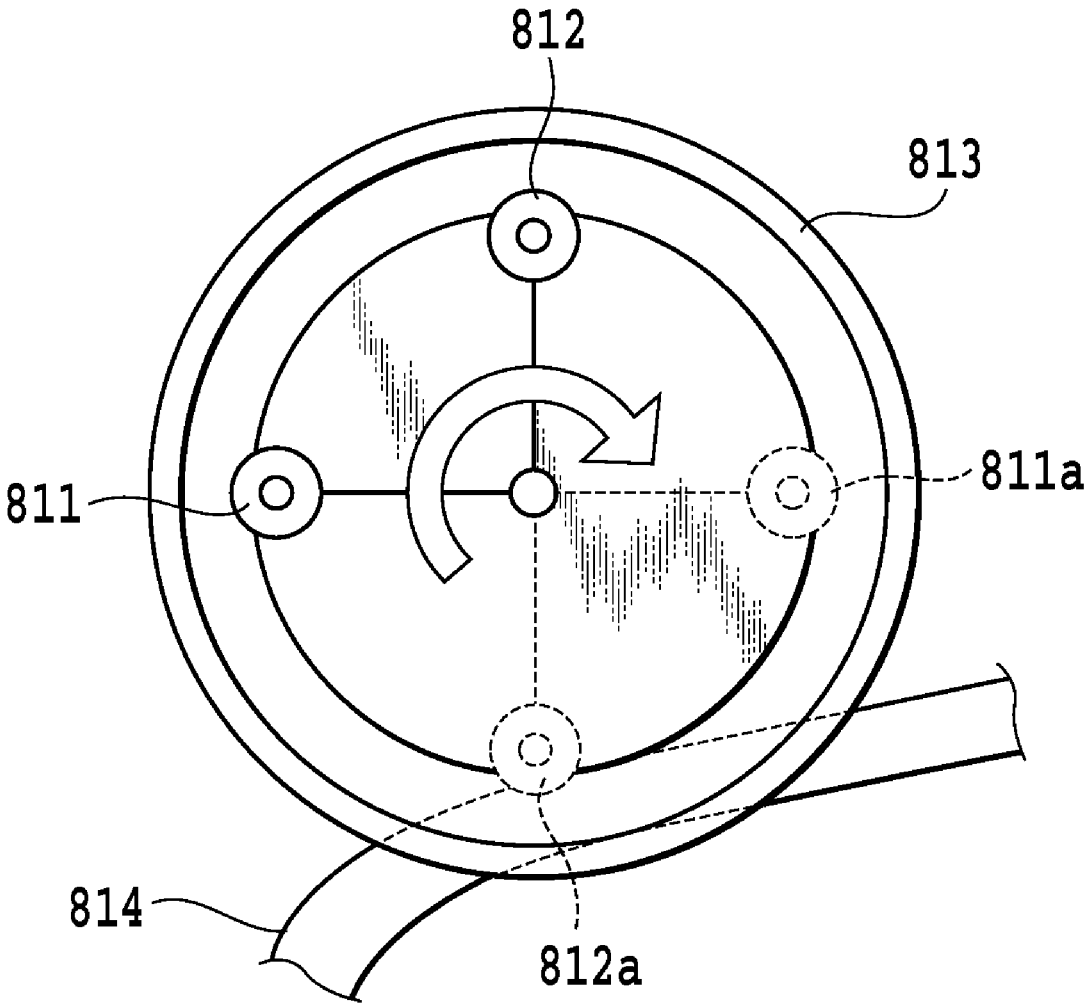
FIG. 14 is a cross-sectional view schematically showing a pump according to a second embodiment of the present invention.
Figure 15:
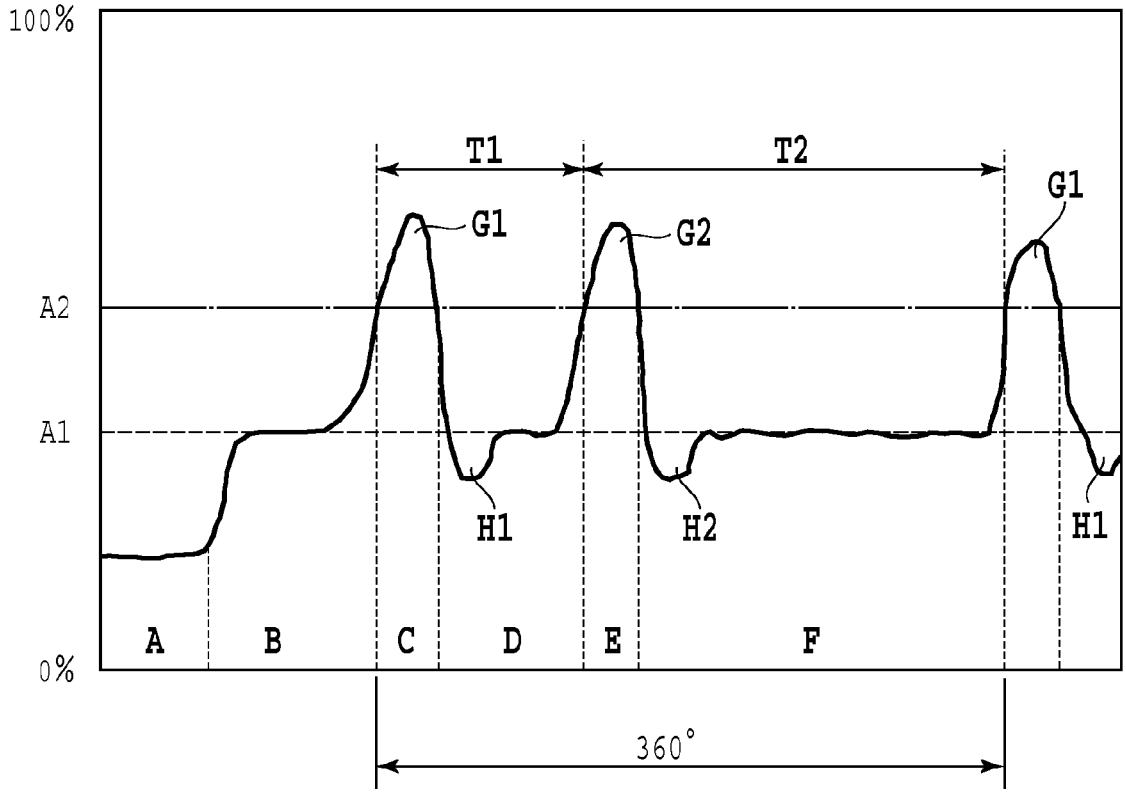
FIG. 15 is a graph showing current waveform when the pump according to the second embodiment is driven by a DC motor.

A second embodiment of the present invention is described below with reference to FIG. 14 and FIG. 15. FIG. 14 is a cross-sectional view schematically showing a configuration in which a tube is pressed by a dual sucking pump constituting a plurality of pressure generating unit, namely by two pump elements (rollers). FIG. 15 is a graph showing a current PWM value for a source of a driving force.

As described above, to optimize the processes performed in a printing apparatus for resolving clogging or for sucking ink for filling, it is required to manage a pressure generated by a pressure generating unit and a discharge rate extremely precisely. To achieve the object, in an inkjet printing apparatus having a plurality of pump elements, it is necessary to detect phases of the plurality of pump elements at positions for generation of a negative pressure, and also to determine each of the phases. When power sources, phase detection sensors, load fluctuation detecting units and the like are provided for the plurality of pump elements respectively, size of the printing apparatus becomes disadvantageously larger and the cost also disadvantageously increases.

In the second embodiment of the present invention, the configuration described below is employed. At first, the configuration is employed in which a first roller 811 constituting one of the two pump elements a second roller 812 constituting another pump element for establishing a plurality of negative pressure generating positions are rotated in the same direction. Furthermore, the first roller 811 and the second roller 812 are located at positions offset against the rotating direction by an angle larger than 0 degree and smaller than 180 degrees. In the example shown in FIG. 14, the first roller 811 and the second roller 812 are located with the phase lag of about 90 degrees. Furthermore, a common DC motor is employed as a driving force source for the plurality of pump elements. In addition, the tube 814 is arranged with the angle of 360 degrees of more in the pump base 813 like in the first embodiment.

When the dual sucking pump is constructed such that the two rollers presses different tubes respectively, the tubes corresponding to the roller 811 and the roller 812 are arranged in the direction perpendicular to the drawing. In FIG. 14, however, the roller 811 and the roller 812 are shown on the same plane, and also only one tube 814 is shown for simplicity.

In the configuration according to the second embodiment of the present invention, when the common DC motor is driven for actuating the plurality of rollers, the current PWM value as shown in FIG. 15 is detected.

In FIG. 15, area A indicates a state in which each of the first roller 811 and the second roller 812 changes from the state where the roller contacts only the sucking tube 814, namely the state where internal walls of the tube are separated from each other by the similar mechanism as that in the first embodiment to the state where the roller starts to squeezes the sucking tube 814, namely to the state where the internal walls of the tube 814 are contacted to each other by the mechanism above. In this state, because the load is smaller, also the PWM value is small.

Area B indicates the state in which the first roller 811 and the second roller 812 have started to squeeze the tube 814, and in this state, the PWM value rapidly rises to a required level for keeping the speed constant in response to increase of the load.

Area C indicates a state the first and second rollers have moved to positions 811*a* and 812*a* shown by the broken line in FIG. 14 and the second roller 812 squeezes the tube at two positions simultaneously. In this state, because a deforming rate of the tube by the second roller 812 becomes smaller and a deflection rate of the compression spring 208 becomes larger as compared to the rates in the state indicated by area B in which the first and second roller are squeezing the tube only at one position respectively, so that the rotating load increases and also the PWM value becomes large (state G1).

In area D, to rapidly return from the state where the second roller 812 squeezes two portions of the tube to the state where the second roller 812 squeezes only one portion of the tube, the rotating load lowers to the level equivalent to that in area B where the first and second rollers squeeze only one portion of different tubes respectively. In this step, the PWM value once overshoots a value lower than that equivalent to that in area B (state H1), and then again returns to the value equivalent to that in area B.

Area E indicates the state where the first roller 811 having a phase lag of about 90 degrees from the second roller 812 simultaneously squeezes the tube at two portions and the current PWM value is high like in area C (state G2).

In area F, the first roller 811 rapidly returns from the state where the roller simultaneously squeezes two portions of the tube to the state where the roller squeezes only one portion of the tube, and therefore the rotating load lowers to a value equivalent to that in area B and area D in which the first and second rollers squeeze the tubes at only one portion respectively. In this step, the PWM value once overshoots to a value lower than that in area B (state H2), and then again returns to that equivalent to that in area B and area D.

The section from area C to area F in FIG. 15 indicates the rotational amount of the second roller 812 by about one circumference.

Because of the configuration as described above, the phase detection can be performed as described below. Namely two threshold values of A1 and A2 are set, and A1 is the PWM value when the first roller 811 and the second roller 812 squeeze tubes at one portion respectively, while A2 is the PWM value when either one of the pump rollers squeezes a tube at two portions simultaneously. Furthermore, times when the current PWM value exceeds A2 while the tube pump rotates once (by 360 degrees) and a time or the rotational amount of the motor from a point of time when the current PWM value is exceeded once until a point of time when a value exceeding the current PWM value A is again detected are recorded.

In FIG. 15, T1 is a period of time or the rotational amount of the motor from the state G1 where the second roller 812 squeezes the tube 814 at two portions to the state G2 where the first roller 811 squeezes the tube 814 at two portions. Also in FIG. 15, T2 is a period of time or the rotational amount of the motor from the state G2 where the first roller 811 squeezes the tube 814 at two portions to the state G1 where the second roller 814 squeezes the tube 814 at two portions. In the configuration according to the second embodiment, because T1 is smaller than T2, it can be determined that the position at which the current PWM value exceeds A2 first time after the value of T1 is obtained corresponds to a PWM value for the state where the second roller 812 squeezes the tube 814 at two portions, and also that the position at which the current PWM value is exceeded second time corresponds to a PWM value for the state where the first roller 811 squeezes the tube 814 at two portions. It can also be determined, on the contrary, that the position at which the current PWM value A1 is exceeded first time after the value of T2 is obtained corresponds to a current PWM value for the state where the first roller 811 squeezes the tube 814 at two portions, and also that the position at which the current PWM value is exceeded second time corresponds to a PWM value for the state where the second roller 812 squeezes the tube 814 at two portions.

As described above, with the second embodiment of the present invention, even when a plurality of pump elements are provided, it becomes possible to precisely manage a generated pressure and a discharge rate without the need of providing any specific sensor or the like to cope with the plurality of pump elements.

It is to be noted that, even when T1 and T2 after the pump is rotated twice or more are employed, the same effect is obtained.

Furthermore, the same effect is obtained by determining a point of time for starting measurement of T1 and T2 or duration of the measurement based on the minimum value (state H1 and state H2).

Although a case of the dual sucking pump was described above for convenience as an example of the second embodiment of the present invention, the same effect can be obtained by applying the same idea to a sucking pump system comprising three or more pump elements.

Third Embodiment

Figure 16:
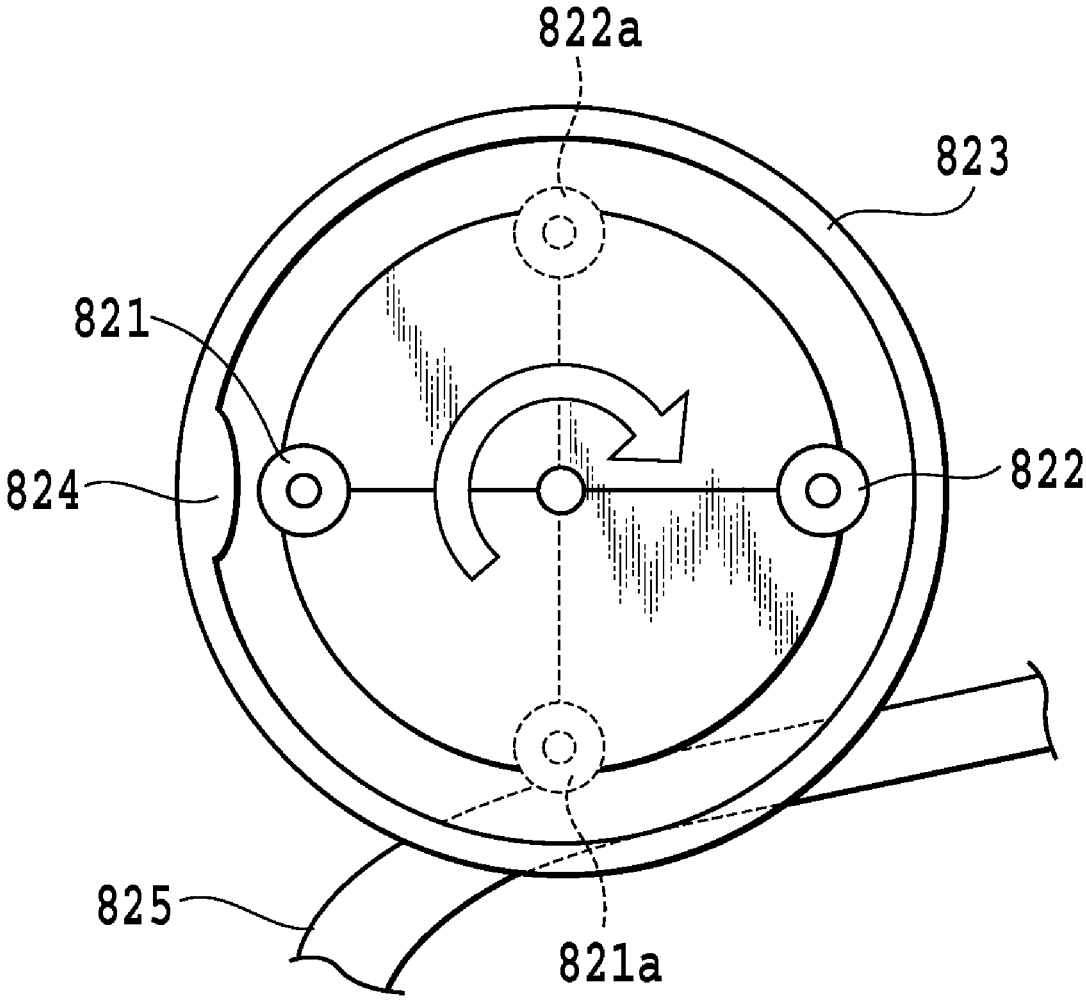
FIG. 16 is a cross-sectional view schematically showing a pump according to a third embodiment of the present invention.

A third embodiment of the present invention is described below with reference to FIG. 16 and FIG. 17. FIG. 16 is a cross-sectional view schematically showing a dual pump system according to the third embodiment, and FIG. 17 is a graph showing a current PWM value for a source of a driving force in this embodiment.

A configuration similar to that in the second embodiment is employed in the third embodiment, but the third embodiment is different from the second embodiment in the point that a first roller 821 and a second roller 822 are located out of alignment by about 180 degrees in the rotating direction. Furthermore, a projection 824 for generating load fluctuations is provided at a position where the projection 824 acts only to the first roller 821 in the inner side from a pump base 823. This projection 824 is located at a position displaced by a certain angle in the rotational direction of the first roller 821 from a tube-overlapped position by arranging the tube over an angle of more than 360 degrees in the pump base 823. Furthermore this projection 824 does not act to the second roller 822. Other points are the same as those in the second embodiment.

Figure 17:
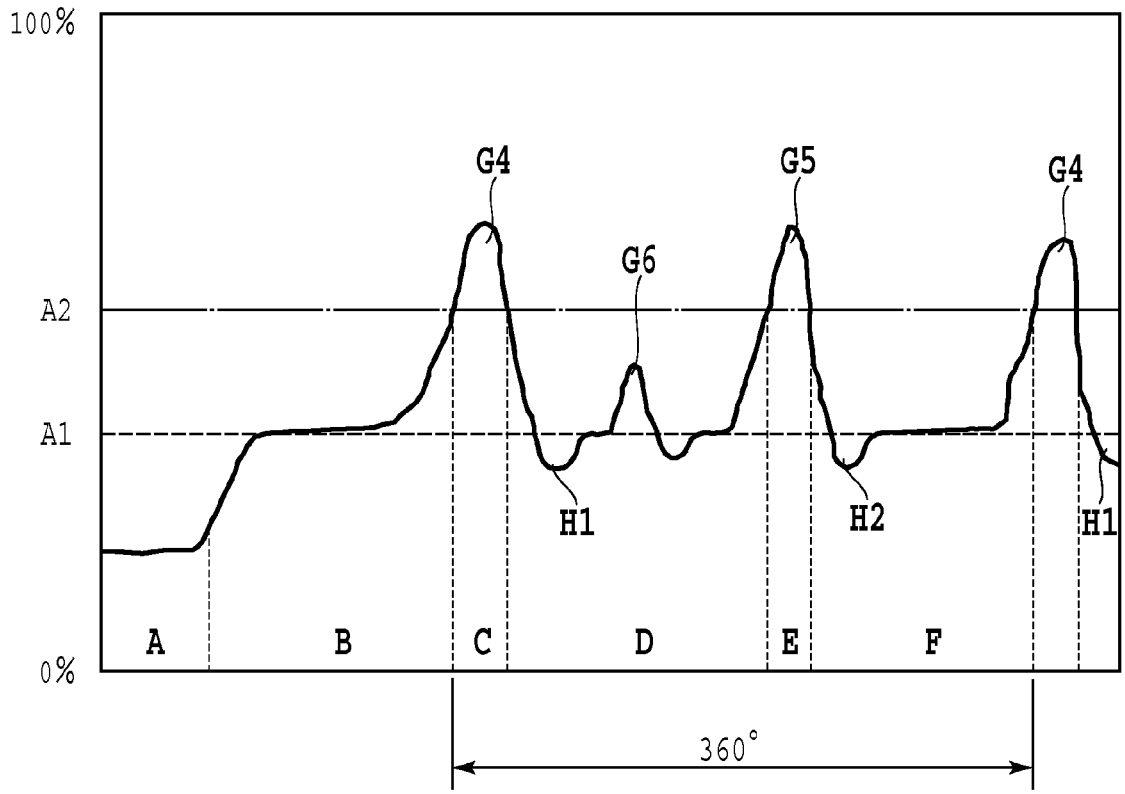
FIG. 17 is a graph showing a current waveform when the pump according to the third embodiment is driven by a DC motor.

In the configuration according to the third embodiment of the present invention as described above, when a common DC motor for actuating a plurality of rollers is driven, the current PWM value as shown in FIG. 17 is detected.

In FIG. 17, area A indicates a change from the state where each of the first roller 821 and the second roller 822 only contacts a sucking tube 825, namely the state where the internal walls of the tube are separated from each other by the mechanism similar to that in the first embodiment to the state where the internal walls of the tuber are contacted to each other and squeezing of the sucking tube 825 is started. In this state, because the load is small, also the PWM value is small.

Area B indicates the state where the first roller 821 and the second roller 822 have started squeezing the tube 825 respectively, and a PWM value required to keep the speed constant in response to increase of the load rapidly becomes higher.

Area C indicates the state where the first and second rollers have displaced to the position 821*a* and the position 822*a* shown by the broken lines in FIG. 16 and the first roller 821 squeezes the tube at two portions. In this state, as compared to the area B where the first and second roller squeeze the tubes at only one portion respectively, a deformation of the tube by the second roller 812 becomes smaller, and a deflection of the compression string 208 becomes larger, so that the rotating load increases and also the PWM value increases (state G4).

Area D, because the first roller 821 rapidly returns to the state where the first roller 821 squeezes the tube at two portions to the state where the first roller 821 squeezes the tube at one portion, the rotating load rapidly drops to a level equivalent to that area B where the first and second rollers squeeze the tube only at one portion respectively. In this step, the PWM value once overshoots to a value lower than that in area B (state H1), and then again returns to the same PWM value as that in area B. Furthermore, in area D, the first roller 821 moves from a position where the first roller 821 squeezes one portion of the tube and rides on the projection 824 provided in the pump base 823. In this step, because a deflection rate of the spring increases in proportion to a height of the projection 824, and also the PWM value becomes higher (state G6). When fluctuations of the load to the DC motor generated by the projection 824 is sufficiently large enough to perform the detection according to the third embodiment, there is no specific restriction over a height of the projection 824. However, to suppress the load generally applied to the DC motor as much as possible, it is desirable to set a height of the projection 824 so that fluctuations of the load become smaller than those in the state where the tube is squeezed at two portions simultaneously. Namely, it is desirable that a height of the projection 824 inside the pump base 823 provided only for the first roller 821 is set so that the current PWM value detected when the first rollers 821 rides on the projection is larger than the value A1 but is smaller than the value A2.

Area E indicates the state where the second roller 822 having a phase lag of about 180 degrees from the first roller 821 are squeezing a tube at two portions, and in this state, the current PWM value is high like in Area C (state G).

In area F, the second roller 822 rapidly return from the state where the roller squeezes the tube at two portions simultaneously to the state where the roller squeezes the tube only at one portion thereof, and therefore, the rotating load drops to that in the state where the first and second rollers squeeze the tube only at one portions respectively. In this step, the current PWM value once overshoots to a value lower than the PWM value in area B (state H2), and then again returns to the PWM value equivalent to that in area B.

A zone from area C to area F in FIG. 17 indicates the rotational amount of the first roller 821 for about one circumference.

Because of the configuration as described above, the phase detection can be performed as described below. Namely two threshold values of A1 and A2 are set, and A1 is the PWM value when the first roller 821 and the second roller 822 squeeze tubes at one portion respectively, while A2 is the PWM value when either one of the pump rollers squeezes a tube at two portions simultaneously. In the configuration as described above, when the tube pump is rotated once or more, there occur the case in which values larger than A2 are detected twice successively, and the case where a value larger than A2 but smaller than A2 is detected at least once. Therefore, it can be determined that the former state in which values larger than A2 are detected twice successively is the state where the second roller 822 squeezes the tube at two portions thereof. Alternatively, it can be determined that, when a value smaller than A2 but is larger than A1 is detected and then a value larger than A2 is detected, the second roller 822 is squeezing the tube at two portions thereof.

As described above, even when the first roller and the second roller are located with a displacement of 180 degrees against the rotating direction, a generated pressure and a discharge rate can be managed with high precision without the need of providing specific sensors corresponding to the rollers respectively.

It is to be noted that the same effect can be obtained even when the pump is rotated twice or more.

Also the same effect can be obtained by determination is made based on the minimum value (like in state H1 and state H2).

The description above is based on the configuration in which the projection 824 acting only to the first roller 821 is provided, but also the configuration is allowable in which the projection 824 acts only to the second roller 822. In addition, although the third embodiment of the present invention is described above assuming a case in which a dual sucking pump is used, the same effect can be obtained by applying the same idea even in a configuration in which a triple or more multiple pump system is employed.

Furthermore, although the projection 824 is provided as an element for fluctuating a load to be applied to a tube pump, but such a unit may be constructed separately from a tube pump, if the unit can cause a change in a load to the DC motor as a source of power for the tube pump in synchronism to rotation of the tube pump.

Fourth Embodiment

Descriptions of the first to third embodiments above are based on the configuration in which a flexible tube is arranged in the angular range of 360 degrees or more, and each roller can squeeze the tube in the entire area. However, the present invention can also be applied to a configuration in which an operation for squeezing the tube is performed within an angular range of less than 360 degrees.

Figure 18:
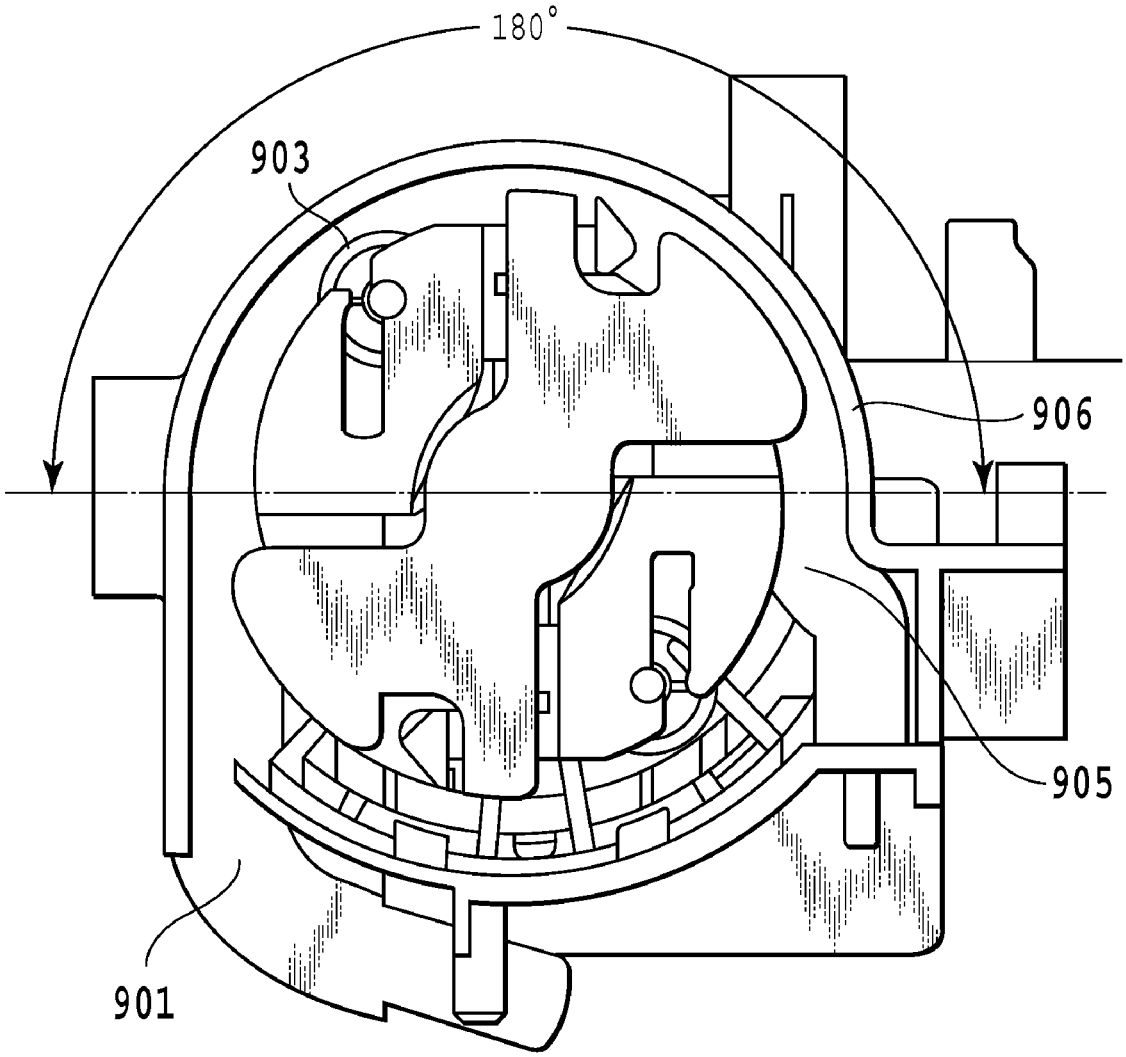
FIG. 18 is a cross-sectional view illustrating a pump according to a fourth embodiment of the present invention.

FIG. 18 is a cross-sectional view illustrating a pump according to a fourth embodiment of the present invention. This pump is a tube pump which performs a sucking operation intermittently by rotating in the CCW direction, and has the configuration in which an angle for squeezing a sucking tube 901 by a roller 903 is less than 360 degrees and the squeezing area is limited to an angular range of about 180 degrees in the upper portion of the figure. In this case, it may be determined, when a PWM value rapidly increases, that the roller 903 is at a phase for starting to squeeze the tube (namely at a point 905 where the arrangement of the tube starts on a member 906 having a curved surface on which a portion of the tube is aligned and supported).

Other Embodiments

In the embodiments described above, the present invention is applied to a configuration in which a tube pump is used as a pressure generating unit. However, the present invention can be applied to a configuration, for example, in which a bellows pump is used as a pressure generating unit. In addition, the processing making use of a pressure is not limited to utilization of a pressure lower than the atmospheric pressure (a negative pressure) like in the embodiments, but a pressurizing force may be utilized. For instance, the configuration is allowable in which ink is forcibly discharged from a ejection opening by pressurizing a ink supply system to a printing head. Furthermore, the processing for forcibly discharging ink may be performed either for resolving clogging at the ejection opening, or for intruding air and completely discharging ink in the printing head for transport or for exchanging the ink with one having a different color.

Figure 19:
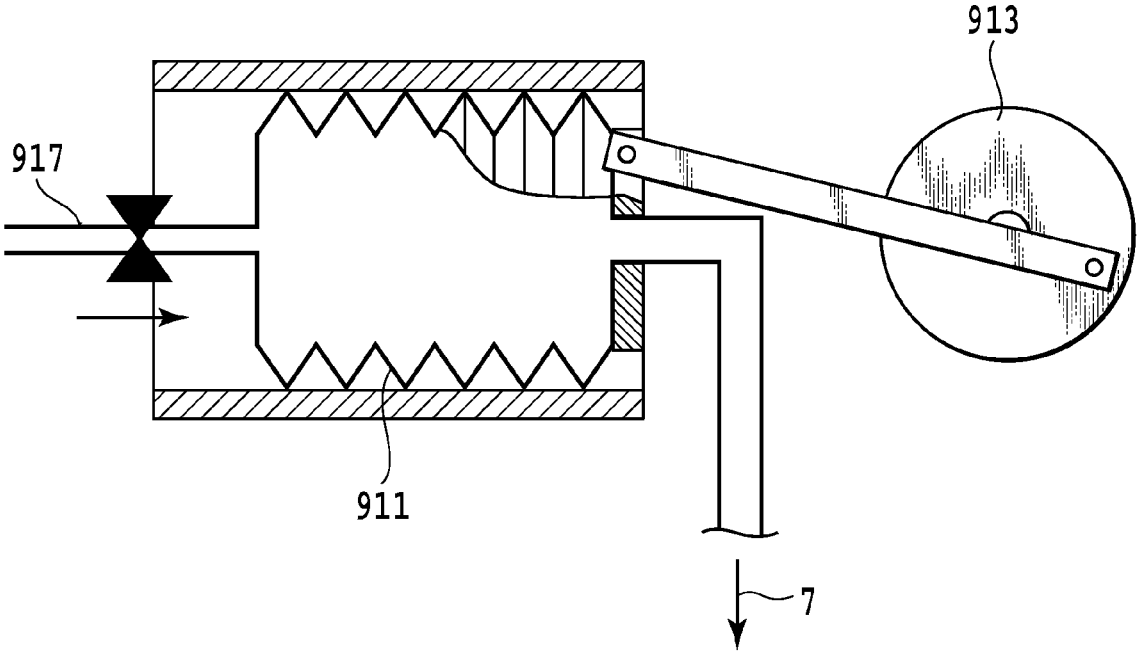
FIG. 19 is a view schematically showing a pump according to a further embodiment of the present invention.

FIG. 19 is a view schematically showing a still different embodiment of the present invention. In the configuration shown in FIG. 19, a bellows pump 911 and a check valve allowing for transferring a fluid only in the direction indicated by an arrow in the figure are provided on a fluid path 917 such as an ink supply path or an air inlet path to the printing head 7. The bellows pump 911 is put into action by a link mechanism capable of converting a rotational movement of a DC motor to a reciprocal movement. With the mechanism, it is possible to configure a intermittently pressurizing unit for a printing head, but at least it is necessary to detect whether the bellows pump 911 is in the compression stroke or in the expansion stroke for proper driving. Otherwise, a discharge rate of ink from the printing head would largely fluctuate. To prevent this problem, it is possible to detect shift of the stroke of the bellows pump, namely whether the bellows pump 911 is in the compression stroke or in the expansion stroke by detecting a PWM value fluctuating a driving load to the link mechanism 913.

In the embodiments described above, the present invention is applied to the so-called serial type of inkjet printing apparatus. However, the present invention can effectively be applied to an inkjet printing apparatus using the so-called full line type of printing head in which nozzles are arranged corresponding to the full width of a printing medium.

Furthermore, there are various types of processing making use of a pressure, and the present invention may be applied to any type of processing so long as a pressure generating unit is used for carrying out at least one of the various types of processing. For instance, the present invention can effectively be applied to a configuration in which a pressure generating unit is used for carrying out one or more of the various types of processing, namely for cleaning a printing head, for filling ink in the printing head, for forcibly discharging ink from the printing hear, or for any other similar purpose.

In addition, there are various types of ink ejecting systems applicable to the inkjet printing apparatus, and it is allowable in the present invention to employ a configuration in which a heater for generating heat is used to cause film boiling of ink when energized as described above, or a configuration in which an electro-mechanical energy transducer element such as a piezoelectric element is used.

Furthermore, in the embodiments described above, the present invention is applied to an inkjet printing apparatus using black, cyan, magenta, and yellow inks, but it is needless to say that the number of and types of color tones such as colors and density may be selected according to the necessity.

Furthermore, numerical values concerning angles or the like employed in the embodiments are only for the purpose of exemplification, and it is needless to say that the present inventions is not limited to the numerical values.

This patent application is to claim priority based on Japanese Patent Application No. 2005-310142 filed on Oct. 25, 2005 as well as on Japanese Patent Application No. 2006-288738 filed on Oct. 24, 2006, and the patent applications are included in this specification by referring thereto.

The invention claimed is:

1. An inkjet printing apparatus which uses a printing head for ejecting ink, the inkjet printing apparatus comprising:

a plurality of negative pressure generating units, each of which has a cap configured to contact an ejection face of the printing head, a tube connected to the cap, and a roller capable of pressing the tube, each negative pressure generating unit generates a negative pressure in the cap by moving the roller while pressing the tube by the roller;

a DC motor which drives the plurality of negative pressure generating units;

a control unit which supplies electrical power to control the DC motor;

a detecting unit which detects the electrical power supplied from the control unit to the DC motor when the plurality of negative pressure generating units are driven; and a determining unit which determines a position of each of the plurality of rollers relative to the respective tube based on the electrical power detected by the detecting unit, wherein the determining unit determines a phase of each of the plurality of rollers based on a result of the detection by the detecting unit.

2. An inkjet printing apparatus as claimed in claim 1, wherein the detecting unit detects a PWM value of a current applied to the DC motor, and functions as a common detecting unit for the plurality of rollers.

3. An inkjet printing apparatus as claimed in claim 2, wherein the plurality of rollers are operated with a phase lag larger than 0 degrees but smaller than 180 degrees, and the determining unit determines a phase of each of the plurality of rollers based on a common current PWM value detected by the detecting unit.

4. An inkjet printing apparatus as claimed in claim 2, further comprising a unit for causing a load fluctuation, different from that occurring when pressures are generated by the plurality of rollers, for any of the plurality of rollers with a phase different from that of an element causing the load fluctuation when the pressure is generated, and the determining unit determines a phase of each of the plurality of rollers by making use of the current PWM value effected by the load fluctuating unit and detected by the detecting unit.

5. An inkjet printing apparatus as claimed in claim 4, wherein the load fluctuating unit is constructed so that the current PWM value caused by the load fluctuating unit is smaller than that caused by the load fluctuating element when the pressure is generated.

6. A method of controlling an inkjet printing apparatus having a printing head capable of ejecting ink, a plurality of negative pressure generating units, each of which has a cap configured to contact an ejection face of the printing head, a tube connected to the cap, and a roller capable of pressing the tube, a DC motor which drives the plurality of negative pressure generating units, a control unit which supplies electrical power to the DC motor, a detecting unit which detects electrical power, and a determining unit which determines a position of each of the plurality of rollers and a phase of each of the plurality of rollers, the method comprising the steps of:

contacting each cap to the ejection face of the printing head;

supplying electrical power to control the DC motor from the control unit;

driving the plurality of negative pressure generating units, using the DC motor, to generate a negative pressure in each cap by moving each roller while pressing each tube by a respective roller;

detecting the electrical power supplied from the control unit to the DC motor when the plurality of negative pressure generating units are driven;

determining a position of each of the plurality of rollers relative to a respective tube based on the electrical power detected in the detecting step; and determining a phase of each of the plurality of rollers based on a result of the detecting step.

7. A method of controlling an inkjet printing apparatus according to claim 6, wherein in the detecting step a PWM value of a current applied to the DC motor is detected.

8. A method of controlling an inkjet printing apparatus according to claim 6, further comprising the steps of:

operating the plurality of rollers with a phase lag larger than 0 degrees but small than 180 degrees, and determining a phase of each of the plurality of rollers based on a common current PWM value detected in the detecting step.

* * * * *